US011708191B2

(12) United States Patent
Silla et al.

(10) Patent No.: US 11,708,191 B2
(45) Date of Patent: Jul. 25, 2023

(54) OPENING/CLOSING DEVICE FOR A CONTAINER FOR POURABLE PRODUCTS

(71) Applicant: EASY PLAST S.R.L., Offida (IT)

(72) Inventors: Roberto Silla, Offida (IT); Luigino Michetti, Offida (IT)

(73) Assignee: EASY PLAST S.R.L., Offida (IT)

( * ) Notice: Subject to any disclaimer, the term of this patent is extended or adjusted under 35 U.S.C. 154(b) by 0 days.

(21) Appl. No.: 17/754,075

(22) PCT Filed: Sep. 24, 2020

(86) PCT No.: PCT/IB2020/058913
§ 371 (c)(1),
(2) Date: Mar. 23, 2022

(87) PCT Pub. No.: WO2021/059172
PCT Pub. Date: Apr. 1, 2021

(65) Prior Publication Data

US 2022/0380087 A1 Dec. 1, 2022

(30) Foreign Application Priority Data

Sep. 25, 2019 (IT) ..... 102019000017249
Jul. 27, 2020 (IT) ..... 102020000018142

(51) Int. Cl.
*B65D 5/74* (2006.01)

(52) U.S. Cl.
CPC ..... *B65D 5/748* (2013.01); *B65D 2401/30* (2020.05)

(58) Field of Classification Search
CPC .... B65D 47/36; B65D 47/38; B65D 51/2835; B65D 51/222; B65D 51/224;
(Continued)

(56) References Cited

U.S. PATENT DOCUMENTS 5,297,696 A * 3/1994 Bernstein ..... B65D 5/748 222/89
5,482,176 A * 1/1996 Maietta ..... B65D 5/748 215/220
(Continued)

FOREIGN PATENT DOCUMENTS

DE 102010028518 A1 11/2011
EP 0947433 A1 10/1999
(Continued)

OTHER PUBLICATIONS

International Search Report and Written Opinion for Corresponding International Application No. PCT/IB2020/058913, 9 pages, dated Jan. 27, 2021.

*Primary Examiner* — Ernesto A Grano
(74) *Attorney, Agent, or Firm* — Lucas & Mercanti, LLP

(57) ABSTRACT

Opening/closing device (1) for a container (100) for pourable products having at least one pierceable portion (101), said opening/closing device comprising a collar (2) combinable with said container at said pierceable portion, a cap (3) provided with a lower portion (3*a*) and displaceable on the outer surface (2*a*) of said collar (2) in a constrained and only rotatable way by first guiding means (40) interposed between said collar (2) and said lower portion (3*a*), and a cutting element (5) movable in a constrained way inside said collar (2) by second guiding means (60), which are interposed between said cutting element (5) and said collar (2) to sever said pierceable portion, said device (1) further comprising pushing means (7) for said cutting element (5) which are driven by said cap (3), at least during its first displacement on said outer surface (2*a*) of said collar (2), such as to aid the displacement of said at least one cutting element inside said collar in direction of said pierceable portion, said cap (3) comprising at least one lid (3*b*) rotatably constrained with respect to said lower portion (3*a*) of said cap (3)
(Continued)

between an opening position (PI) and a closing position (P2), and vice-versa, characterized by comprising releasing/engaging means (10) between said lid (3*b*) and said collar (2) such as to allow the opening/closing of said lid depending on the rotation angle reached by said cap (3) with respect to said collar (2), after the first displacement of said cap on said outer surface (2*a*) of said collar (2), said opening of the lid being allowed only when said cap reaches a rotation angle such as the pouring is handier for the user, and once the lid has been reclosed, said lied being lockable in stable position with the collar by rotating the cap with respect to the collar so that to reach a rotation angle different from that in which said lid is rotatable with respect to the lower portion of the cap.

25 Claims, 15 Drawing Sheets

(58) Field of Classification Search
CPC .. B65D 51/226; B65D 5/748; B65D 2401/30; B65D 2251/101
USPC ..... 215/200, 232, 254
See application file for complete search history.

(56) References Cited

U.S. PATENT DOCUMENTS 5,853,109 A * 12/1998 Elliott ..... B65D 51/224 222/83
5,960,992 A * 10/1999 Bernstein ..... B65D 5/748 222/88
6,185,906 B1 * 2/2001 Mogard ..... B65D 47/0842 53/410
7,163,127 B2 * 1/2007 Seelhofer ..... B65D 47/0804 222/83
7,207,465 B2 * 4/2007 Weist ..... B65D 5/748 222/83
7,458,486 B2 * 12/2008 Weist ..... B65D 51/2835 222/83
7,959,032 B2 * 6/2011 Bolli ..... B65D 5/748 222/93
8,505,760 B2 * 8/2013 Ott ..... B65D 5/748 222/541.6
8,672,167 B2 * 3/2014 Leuenberger ..... B65D 5/748 220/267
8,714,380 B2 * 5/2014 Casale ..... B65D 5/029 215/297
8,720,744 B2 * 5/2014 Barron ..... B67B 7/24 222/83
9,487,324 B2 * 11/2016 Benkö ..... B65D 5/4266
10,676,261 B2 * 6/2020 Berge ..... B65D 51/222
10,752,398 B2 * 8/2020 Hauser ..... B65D 5/748
2004/0026422 A1 * 2/2004 Westphal ..... B65D 51/226 220/277
2006/0151421 A1 * 7/2006 Rho ..... B65D 51/224 220/521
2007/0181522 A1 * 8/2007 Davidson ..... B65D 47/0828 215/388
2022/0106092 A1 * 4/2022 Gauxachs ..... B65D 47/0857
2022/0177188 A1 * 6/2022 Minnette ..... B65D 5/748

FOREIGN PATENT DOCUMENTS

EP 1088764 A1 4/2001
EP 3453638 A1 3/2019
WO 2007031585 A1 3/2007

* cited by examiner

OPENING/CLOSING DEVICE FOR A CONTAINER FOR POURABLE PRODUCTS

CROSS-REFERENCE TO RELATED APPLICATIONS

This application is a 371 of PCT/IB2020/058913 filed Sep. 24, 2020, which claims the benefit of Italian Patent Application No. 102019000017249 filed Sep. 25, 2019 and Italian Patent Application No. 102020000018142 filed Jul. 27, 2020.

FIELD OF THE INVENTION

The present invention concerns an opening/closing device for a container adapted to contain pourable products. In particular, such opening/closing device is of the three-piece type, i.e. provided with a collar having a flange combinable at a pierceable portion of the container, a cutting element adapted to pierce the cutting portion during the first opening of the device, and an upper cap constrained to the collar and whose task is to both to control the displacement of the cutting element at the first opening of the device and to preserve the pourable product inside the container until the container, although open, still hasn't been completely emptied of its content.

BACKGROUND OF THE INVENTION

Opening/closing devices of this type are known. For example, the patent EP1088764 in the name of Tetra Laval describes a three-piece closing device of the type discussed above.

Such opening/closing device is extremely efficient but is not however devoid of drawbacks, especially in terms of environmental impact. In fact, once removed, the cap is not always repositioned on the collar since it is either distractedly thrown away by the user immediately after the first opening, or falls to the ground and is thus no longer hygienically usable. This clearly is extremely harmful for the environment since the cap, as the whole closing/opening device, is made of plastic.

In order to overcome such drawback, an opening/closing device preventing the cap from separating from the collar after its opening is known.

For example, document DE102010028518, in the name of Robert Bosch GmbH, describes an opening/closing device for a container for pourable products having a pierceable portion and comprising a collar combinable with the container at the pierceable portion, a cap provided with a lower portion and displaceable on the outer surface of the collar in a constrained and only rotatable way by guiding means interposed between the collar and the lower portion, and a cutting element movable in a constrained way inside the collar by second guiding means interposed between the cutting element and the collar to sever the pierceable portion. Such device further comprises pushing means for pushing the cutting element and driven by the cap, during its first displacement on the outer surface of the collar, such as to aid the displacement of the cutting element inside the collar in direction of the pierceable portion. Advantageously, the cap comprises a lid integrally constrained in a rotatable way with respect to the lower portion of the cap to open or close the container. Thanks to this solution, the cap will never separate from the collar and it will be contemporaneously possible to pour the product from the container by simply opening the lid rotatably combined with the cap.

Unfortunately, this solution is not without drawbacks. In fact, the opening of the cap can occur regardless of its position with respect to the collar. This implies that the user can erroneously open the cap when it is oriented in an unfavorable position for the pouring of the liquid contained inside the container and, thus, that the liquid is poured uncomfortably by the user or, in the worst cases, that a part of the liquid poured comes out of the container in an uncontrolled way. This especially occurs in all those cases wherein the opening device is arranged on the upper face of the container, in a non-central position but in proximity of one of the four edges or of one of the corners of the container.

Object of the present invention is thus to implement a three-piece opening/closing device of the type described above that reduces, or completely eliminates, the pollution issues caused by the containers for pourable products of the known art and which contemporaneously prevents the product contained in the container from being poured with difficulty by the user, or from coming out of the container in an uncontrolled way. Further object of the present invention is to implement an opening/closing device that is anyhow simple from a structural point of view and, thus, simple and economic to produce.

Finally, object of the present invention is to implement a method for opening a container that solves the issues mentioned above.

SUMMARY OF THE INVENTION

These and other objects are reached by an opening/closing device for a container for pourable products having at least one pierceable portion, said opening/closing device comprising a collar combinable with said container at said pierceable portion, a cap provided with a lower portion and displaceable on the outer surface of said collar in a constrained and only rotatable way by first guiding means interposed between said collar and said lower portion, and a cutting element movable in a constrained way inside the collar by second guiding means interposed between said cutting element and said collar to sever said pierceable portion, said device further comprising pushing means for pushing said cutting element and driven by said cap, at least during its first displacement on said outer surface of said collar, such as to aid the displacement of said at least one cutting element inside said collar in direction of said pierceable portion, said cap comprising at least one lid rotatably constrained with respect to said lower portion of said cap between an opening position and a closing position, and vice-versa, characterized by comprising releasing/engaging means between said lid and said collar such as to allow the opening/closing of said lid depending on the rotation angle reached by said cap with respect to said collar, after the first displacement of said cap on said outer surface of said collar.

Such solution clearly allows to prevent the product contained in the container from being poured with difficulty by the user or, worst, from coming out of the container in an uncontrolled way. In fact, the lid combined with the cap can only be opened when the cap is conveniently oriented with respect to the collar. In practice, depending on the position of the opening/closing device on the container, it will be possible to allow the opening of the lid only when the cap reaches a rotation angle such as the pouring is handier for the user. Contemporaneously, once the lid has been reclosed, it will be possible to lock it in stable position with the collar by rotating the cap with respect to the collar so that to reach a rotation angle different from that in which the lid is rotatable with respect to the lower portion of the cap.

It should be noted here and hereunder that the rotation angle mentioned above in which it is possible to open the lid will also be named "opening angle" (and will be denoted by the reference B1), whereas the rotation angle different from that in which the lid is rotatable with respect to the lower portion of the cap is also named "different closing angle," or "closing angle" (and will be denoted by the reference B2).

In particular, said releasing/engaging means allow the opening/closing of said lid within an angular interval reached by said cap with respect to said collar, starting from the initial assembled position of said cap with respect to said collar; said releasing/engaging means allow the opening of said lid in said opening angle of said angular interval which is reached by said cap in a first rotation direction with respect to said collar, and prevent the opening of said lid in a different closing angle of said interval of rotation, which is reached by said cap in a rotation direction opposite said first rotation direction with respect to said collar, wherein said opening angle is preferably greater than the rotation angle necessary for said cutting element to sever said pierceable portion and is measured starting from said initial assembled position of said cap with respect to said collar. Said cap is arranged at an angle of 0° with respect to said collar in said assembled position.

Moreover, said releasing/engaging means comprise at least one locking tooth, combined with said lid, and at least one guide for said tooth, combined with the outer surface of said collar, or vice-versa, wherein said guide is provided with at least one first region along which said locking tooth is constrained to slide, such as to hold said lid engaged with said collar in its closing position, and at least one second region wherein said tooth is free from constraints, such as to release said lid from the engagement with said collar and such as to allow said lid to reach its opening position. Such solution is constructively simple and allows a simple use of the opening/closing device by the user.

In particular, said at least one first region of said guide comprises at least one jutting-out profile that can be engaged with said at least one locking tooth to lock the rotation of said lid, thus holding it in its closing position.

In substance, at the jutting-out profile, preferably having a partially circular cross-section, the locking tooth/teeth hold(s) the lid in its position of constraint with the collar, whereas, in the parts of the guide in which the annular profile is lacking, i.e. in one or more of the second regions, the tooth is free from constraints and, thus, the lid itself moves to its opening position following the rotation of the lid with respect to the collar so that to allow the pouring of the liquid contained in the container.

In detail, said locking tooth protrudes from the inner surface of said lid and said at least one first region extends on part of the perimeter of the outer surface of said collar. In practice, the profile is not made on the whole circumference of the collar, i.e. does not make a full 360° circle but has one or more second regions devoid of the jutting-out profile, at which the locking tooth is no longer constrained to slide along the first region but is disengaged therefrom. The lid is rotatable with respect to the lower portion of the cap at such second region.

According to a particular aspect of the invention, the device further comprises limiting means for limiting the rotation between said cap and said collar.

In particular, said limiting means for limiting the rotation comprise a first protruding element protruding from said lower portion of said cap and at least one seat combined with said outer surface of said collar, or vice-versa, wherein said first protruding element is combined with said seat at the end of the assembling operation of said opening device such as to restrain said cap in its assembled position with said collar, at least before the first displacement of said cap on said outer surface of said collar. Said cap is arranged at an angle of 0° with respect to said collar in said assembled position.

Still, said seat is shaped to allow the rotation of said cap in a first rotation direction at the exceeding of a given torsional force to which said cap is subjected.

As an alternative with respect to the previous case described, said limiting means for limiting the rotation comprise a first protruding element protruding from said lower portion of said cap and a reference element to orient said cap with respect to said collar at the end of the assembling operation of said opening/closing device, wherein said first protruding element is combined in contact with a first surface of said reference element at the end of the assembling operation of said opening/closing device, at least before the first displacement of said cap on said outer surface of said collar, said cap being arranged at an angle of 0° with respect to said collar in said assembled position. In particular, said reference element is shaped to allow the rotation of said cap in said first rotation direction away from said first surface of said reference element. Moreover, said limiting means comprise a second protruding element arranged on said outer surface of said collar and shaped to allow the rotation of said cap in said first direction and to prevent the rotation of said cap in the opposite rotation direction, only after said first protruding element has gone beyond said second protruding element; said at least one second region of said guide is arranged on said outer surface of said collar in a position such as to be met by said at least one locking tooth when said cap, rotated with respect to said collar, is in a position such as said first protruding element is in the angular interval of rotation comprised between said second protruding element and said seat, or between said second protruding element and the second surface of said reference element.

In particular, the angular interval comprised between said second protruding element and the seat, or between said second protruding element and said reference element, is between 100° and 355°, starting from the assembled position of the cap with respect to the collar. Preferably, such rotation angle is between 180° and 355°, in particular between 300° and 355°.

Advantageously, said at least one second region of said guide is arranged on said outer surface of said collar in a position such as to be met by said locking tooth when said cap, rotated with respect to said collar (in said first rotation direction), is in a position such as said first protruding element is in abutment against said seat or said second surface of said reference element, within the angular interval of rotation comprised between said second protruding element and said seat, or said reference element, preferably at said opening angle of said interval of rotation.

Advantageously, said first region of said guide is arranged on said outer surface of said collar in a position such as to be met by said locking tooth when said cap, rotated with respect to said collar in said opposite rotation direction, is in a position such as said first protruding element is in abutment against said second protruding element, at said different closing angle of said interval of rotation.

Always according to a further embodiment of the invention, said at least one second region of said guide comprises a ramp shaped to guide said locking tooth along a path with vertical component, such as to push said lid away with respect to said collar and to aid the opening of said lid; said ramp is reached by said at least one locking tooth when said first protruding element reaches said opening angle. Such solution allows to facilitate the opening of the lid of the container by simply turning the cap until reaching the opening angle of the interval of rotation. Such solution thus allows to raise the lid of the cap even before the user can do it. In fact, in its rotation to reach the opening angle of the angular interval of rotation of operation, the lid is not only subjected to a horizontal rotary movement, but also to a direct upward movement, since said ramp is inclined upwards.

Moreover, said limiting means comprise one or more temporary stop elements arranged in proximity of said second protruding element and/or said second surface of said reference element, or said seat, such as said first protruding element is held—also only temporarily—in said opening angle, or in said different closing angle, when arranged between said second protruding element and said first stop element, and/or arranged between said stop element and said seat, or said second surface of said stop element; said one or more stop elements are anyhow shaped to allow the rotation of said cap with respect to said collar in direction of said opening angle, starting from said closing angle, or from said closing angle starting from said opening angle, at the exceeding of a further torque (beyond that which is necessary to simply rotate the cap with respect to the collar) exerted by the user on the cap, so that to allow said at least one first protruding element to exceed the resistance provided by said one or more stop elements.

In practice, such stop elements, which in cooperation with the second protruding element or seat, or reference element, allow to hold the cap in stable position when it reaches said opening angle or said closing angle within the interval of rotation in which the operation of the engaging/releasing means occurs, respectively, to allow the opening of the cap and to prevent the opening of the cap. This way, when the cap is, for example, at the different closing angle, it is not possible to accidentally (for example by the force of gravity only or due to small forces) bring the cap back at the opening angle since such operation is prevented by the presence of a temporary stop element. However, if a given torque is exerted by the user on the cap, the first protruding element is able to exceed the resistance offered by the stop element and, thus, to move either in direction of the opening angle or of the different closing angle depending on where the cap is with respect to the collar at that moment. Moreover, said lid and said lower portion of said cap are integrally constrained together by means of at least one frangible bridge at least before the first rotation of said lid with respect to said lower portion, such as to switch from said closing position to said opening position at the exceeding of a given force such as to cause at least one frangible bridge to break. Thus, the first rotation of the lid with respect to the lower portion can occur at the exceeding of a given force exerted on the lid by the user to overcome the resistance of said at least one frangible bridge.

The objects are also achieved by the method for opening a container for pourable products provided with an opening/closing device according to one or more of claims 1 to 17, comprising the steps of:

a) rotating said cap with respect to said collar;

b) causing, during said step a), the displacement of said cutting element in direction of said pierceable portion of said container in order to sever it;

c) raising said lid integral with said cap from its closing position to its opening position to pour the product contained in said container;

characterized in that said step c) comprises the step c1) of allowing the opening/closing of said lid depending on the rotation angle reached during said step a) by said cap with respect to said collar, after the first displacement of said cap on said outer surface of said collar, said opening of the lid being allowed only when said cap reaches a rotation angle such as the pouring is handier for the user, and once said lid has been reclosed, said lid being lockable in stable position with the collar by rotating the cap with respect to the collar so that to reach a rotation angle different from that in which said lid is rotatable with respect to the lower portion of the cap.

Moreover, said step c1) occurs whenever said cap, during said step a), has reached an angular interval of rotation measured starting from the initial assembled position of said cap with respect to said collar, said releasing/engaging means allowing the opening of said lid within said opening angle of said interval of rotation which is reached by said cap in a first rotation direction with respect to said collar, and preventing the opening of said lid in a different closing angle of said interval of rotation, which is reached by said cap in a rotation direction opposite said first rotation direction with respect to said collar, said opening angle being greater than the rotation angle necessary for said cutting element to sever said pierceable portion during said step b) of the method and being measured starting from said initial assembled position of said cap with respect to said collar, said cap being arranged at an angle of 0° with respect to said collar in said assembled position.

In particular, during said step c) of the method, said interval of rotation is between 100° and 355°, preferably between 180° and 355°, even more preferably between 300° and 355°, starting from the assembled position of the cap with respect to said collar.

According to the preferred embodiment described herein, said step c) comprises the step c0) of causing said at least one frangible bridge, integrally connecting said lid to said lower portion of said cap, to break at the first rotation of said lid with respect to said lower portion during said step c), such as to switch from said closing position to said opening position.

In particular, previous to said step a), the step of combining said cap with said collar is provided such as a first protruding element protruding from said lower portion of said cap is combined at least with one seat or with a first surface of said reference element, combined with said outer surface (2*a*) of said collar (2), or vice-versa, and characterized in that said step a) comprises the step a1) of allowing, by appropriately shaping said seat, the rotation of said cap with respect to said collar in a first rotation direction, at the exceeding of a given torsional force to which said cap is subjected. In said assembled position said cap is arranged at an angle of 0° with respect to the collar, or said step a) comprises the step a1') of allowing, by appropriately shaping said reference element, the rotation of said cap in said first rotation direction away from said first surface of said reference element.

Moreover, said step a) comprises the step a2) of making said at least one protruding element reach and go beyond said second protruding element, during the rotation of said cap in said first rotation direction, wherein said second protruding element is arranged on said outer surface of said collar and shaped to allow the rotation of said cap in said first direction and to prevent the rotation of said cap in the opposite rotation direction, only after said first protruding element has gone beyond said second protruding element, wherein said at least one second region of said guide is arranged on said outer surface of said collar in a position such as to be met by said locking tooth when said cap, rotated with respect to said collar, is in a position such as said first protruding element is within the angular interval of rotation comprised between said second protruding element and said seat, or said second surface of said reference element.

In practice, the opening of the lid of the cap is only possible in the aforementioned angular interval comprised between said second protruding element and the aforementioned seat, or the reference element. Within this angular interval, the cap can rotate in both directions, however, the locking tooth is at the second region of the guide in a given angle and the opening of the lid is thus allowed, the lid no longer being integral with the collar. Once the product has been poured, the lid is rotated in the opposite direction and, then, the cap is rotated such as to reach a position such as it is held locked in position with the collar. Such position is advantageously achieved with the first protruding element in contact with the second protruding element, although it can also be achieved in a whole closing angular interval contained within the angular interval of rotation within which the releasing/engaging means operate.

Still, said step c) further comprises the step c2) of guiding said locking tooth along a ramp obtained on said second region of said guide such as to make it follow a path with vertical component, such as to push said lid away with respect to said collar and to aid the opening of said lid, said ramp being reached by said at least one locking tooth when said first protruding element reaches said first opening angle.

Still, said step c) comprises the step c3) of holding said first protruding element in said opening angle and/or said closing angle of said angular interval in which said engaging/releasing means operate, the rotation of said cap with respect to said collar in direction of said closing angle, starting from said opening angle, or of said opening angle, starting from said closing angle, being allowed at the exceeding of a further torsional force exerted by the user on the cap to allow said first protruding element to exceed the resistance of said one or more temporary stop elements.

Always according to the invention, a method of producing an opening/closing device according to one or more of claims 1 to 17 is provided, comprising the step a) of injection molding said cap, the step b) of injection molding said collar and the step c) of injection molding said cutting element, characterized in that said step a) comprises the step a0) of injection molding said lid and said lower portion of said lid, wherein said lid and said lower portion of said cap are integrally constrained together by means of at least one frangible bridge at least before the first rotation of said lid with respect to said lower portion, such as to switch from said closing position to said opening position at the exceeding of a given force such as to cause said at least one frangible bridge to break.

DESCRIPTION OF THE FIGURES

Some particular embodiments of the present invention will now be described by way of example only and without limitations with respect to the accompanying figures, in which.

DETAILED DESCRIPTION OF A PREFERRED EMBODIMENT OF THE PRESENT INVENTION

With particular reference to such figures, 1 denotes the generic opening/closing device according to the invention.

Figure 1B:
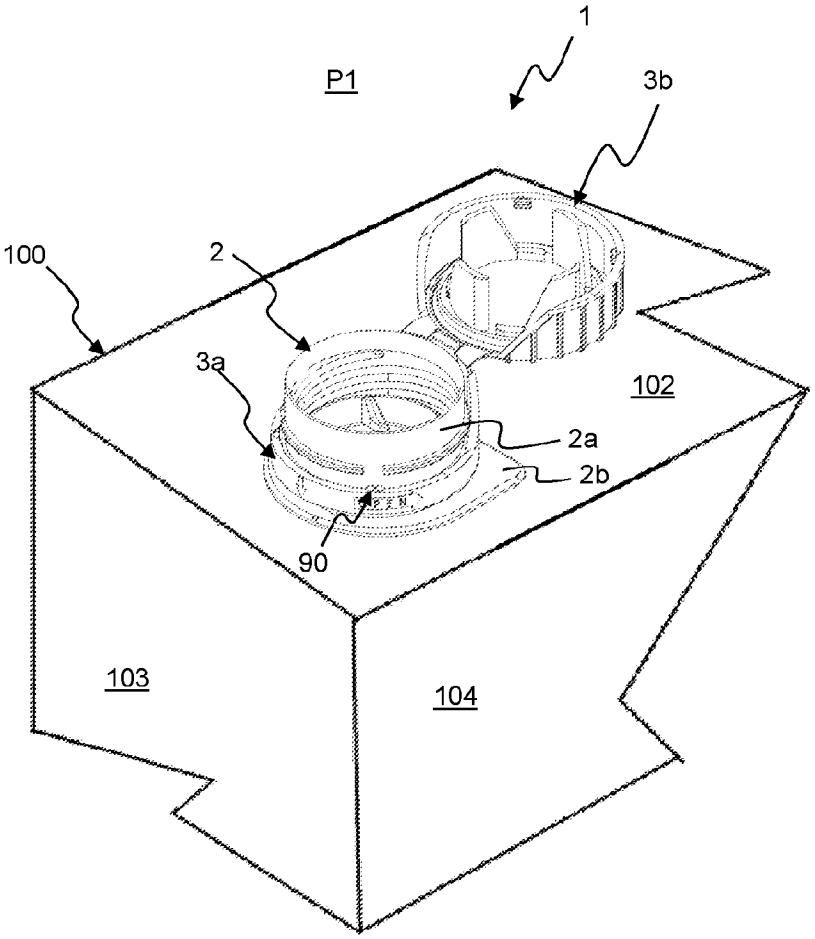
FIG. 1B is an axonometric view of the opening/closing device according to the invention, open and mounted on a container for pourable products.
Figure 1A:
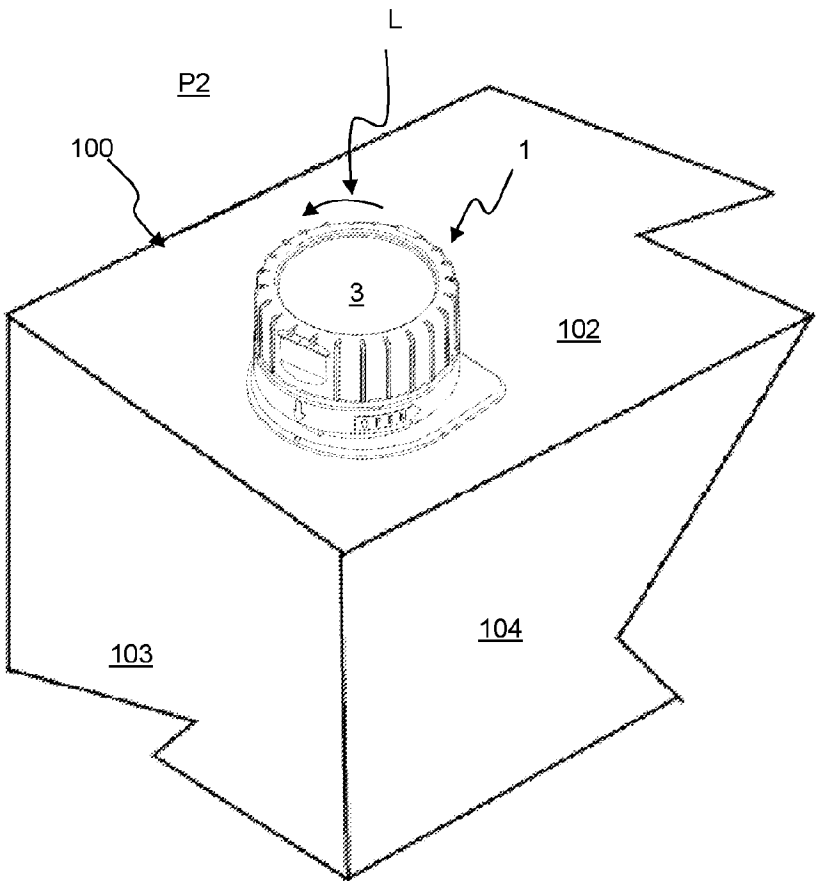
FIG. 1A is an axonometric view of the opening/closing device according to the invention, still closed and mounted on a container for pourable products.
Figure 1C:
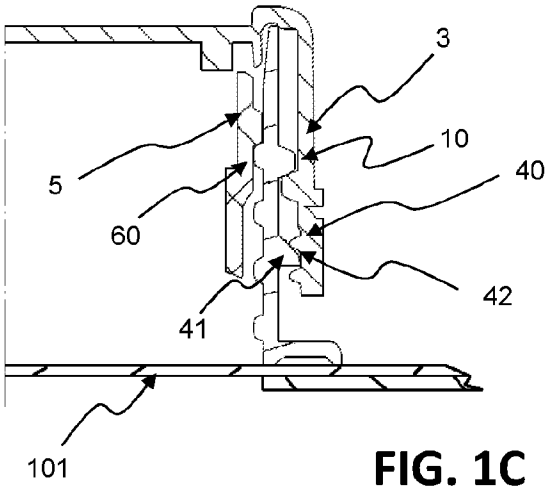
FIG. 1C is a partial longitudinal sectional view of the opening/closing device of FIG. 1A.
Figure 3B:
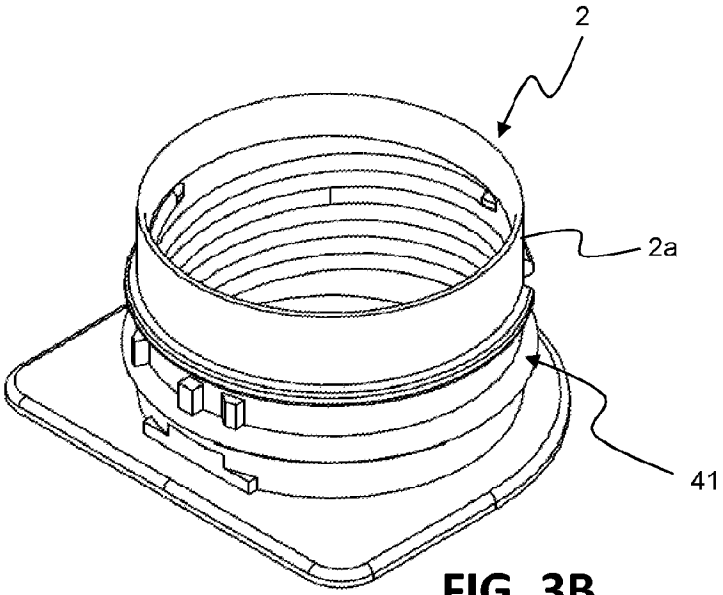
FIG. 3B is an axonometric top view of the collar of the opening/closing device according to the invention, rotated by 180°.
Figure 3A:
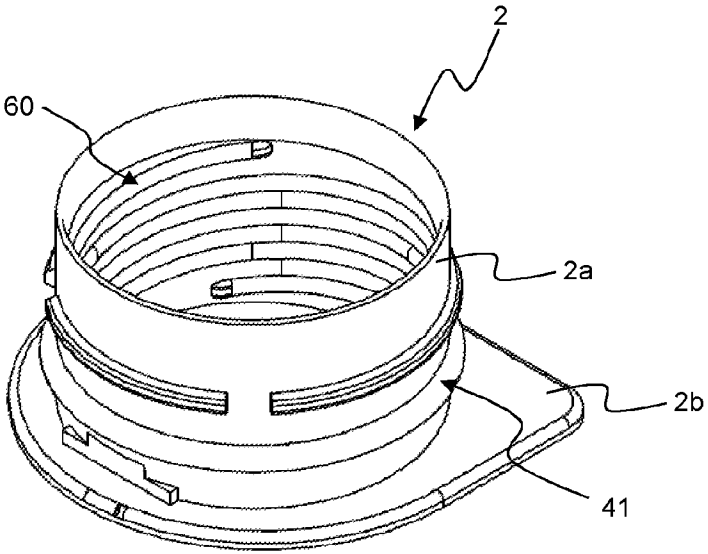
FIG. 3A is an axonometric top view of the collar of the opening/closing device according to the invention.
Figure 2B:
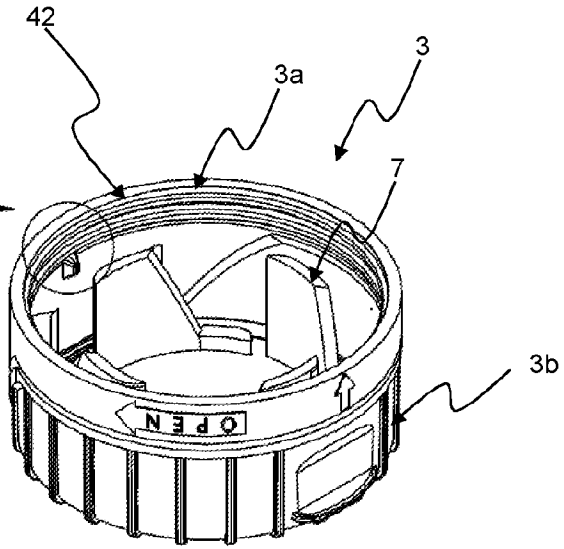
FIG. 2B is an axonometric bottom view of the cap of the opening/closing device shown in FIG. 2A, rotated by 180°.
Figure 2D:
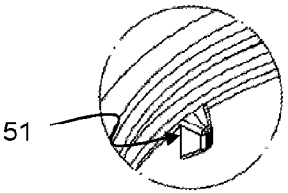
FIG. 2D is a particular view of the cap of the opening/closing device of FIG. 2B.
Figure 2A:
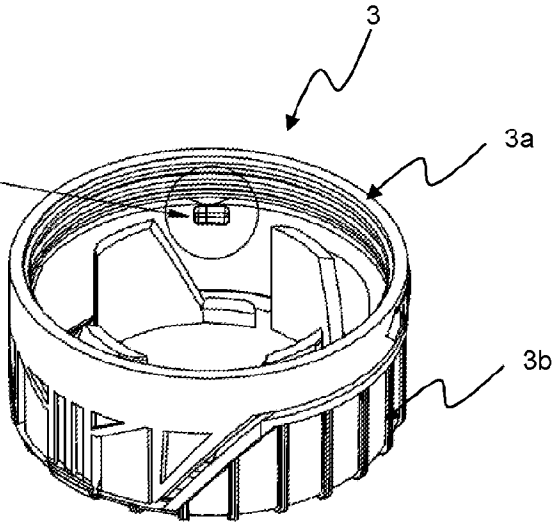
FIG. 2A is an axonometric bottom view of the cap of the opening/closing device according to the invention.
Figure 2C:
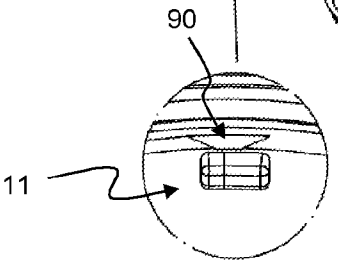
FIG. 2C is a particular view of the cap of the opening/closing device of FIG. 2A.
Figure 4B:
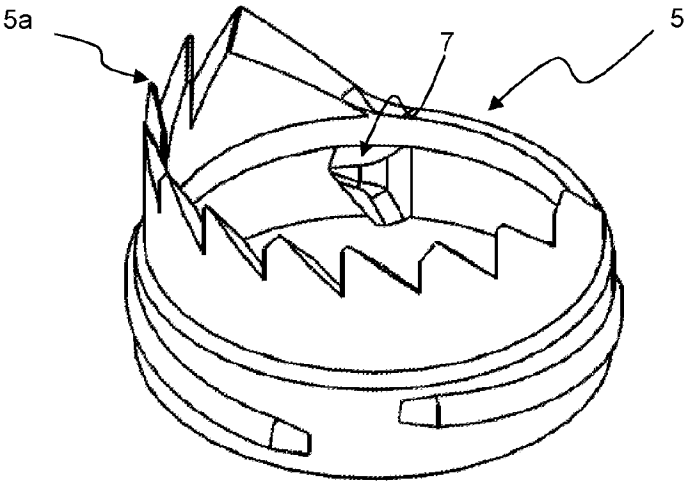
FIG. 4B is an axonometric bottom view of the cutting element of the opening/closing device according to the invention.
Figure 4A:
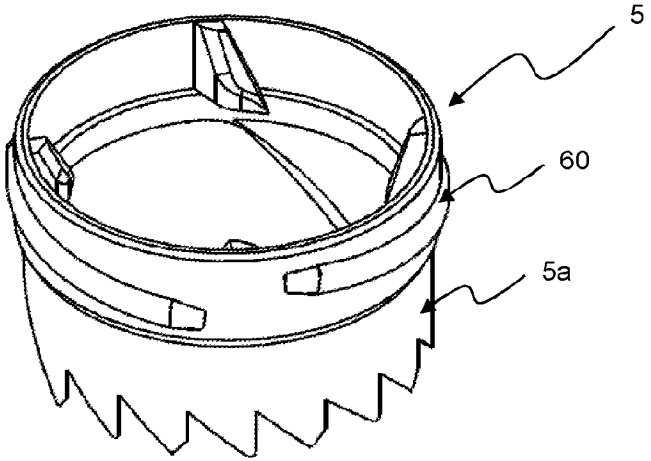
FIG. 4A is an axonometric top view of the cutting element of the opening/closing device according to the invention.

The opening/closing device 1 is applied on a container 100 (not completely shown here, but known to the expert of the sector) for pourable products having a pierceable portion 101 (shown only partially in FIG. 1C, however known to the technician of the sector). Such container 100 is made in a known way by means of a laminated material obtained by overlapping with one another various layers of paper, cardboard, polyethylene and/or other additional materials, appropriately shaped and folded, generally parallelepiped-shaped, and having a perforable portion 101, i.e. a portion of the laminated material devoid of the paper, or cardboard, layer at their end, and thus easily perforable by a cutting body to thus allow the outflow of the liquid contained in the container 100.

The opening/closing device 1 for a container 100 for pourable products comprises a collar 2 combinable with the container 100 at the pierceable portion 101, a cap 3 provided with a lower portion 3*a* and displaceable on the outer surface 2*a* of the collar 2 in a constrained and only rotatable way to first guiding means 40 interposed between the collar 2 and the lower portion 3*a*. Such first guiding means 40 comprise a ring 41 running around the whole circumference of the collar and a corresponding U-shaped profile 42 integral with the cap 3, at its lower portion 3*a*, and adapted to slide on the ring 41 once the cap 3 has been assembled to the collar 2. In practice, the profile 42 is astride the ring 41 and shaped such as the cap 3 cannot be released from the collar 2 even if stressed by an upward vertical force. In a known way, the collar 2 also comprises a flange 2*b* constrained by gluing to the upper face 102 of the container 100, orthogonal to two faces 103 and 104, respectively to the side and front of the container 100 itself.

The device 1 further comprises a cutting element 5 movable inside the collar 2 in a constrained way by second guiding means 60 interposed between the cutting element 5 and the collar 2 to sever the pierceable portion 101 of the container 100. Such cutting element 5 comprises appropriate teeth 5*a* to sever the aforementioned pierceable portion 101. Still, the device 1 further comprises pushing means 7 for pushing the cutting element 5 and driven by the cap 3, during its first displacement, i.e. its first rotation, on the outer surface 2*a* of the collar 2, such as to aid the displacement of the cutting element 5 inside the collar 2 in direction of the pierceable portion. Moreover, the cap 3 comprises a lid 3*b* rotatably constrained with respect to the lower portion 3*a* of the cap 3 between an opening position P1 and a closing position P2. The rotation between the lid 3*b* and the lower portion 3*a* of the cap 3 is obtained by means of a plastic hinge 3*c*. As shown in the accompanying figures, it should further be specified that the lid 3*b* and the lower portion 3*a* of the cap 3 are integrally constrained together by means of two frangible bridges 90 (only one is shown in the figures) before the first rotation of the lid 3*b* with respect to the lower portion 3*a*, such as to switch from the closing position P2 to the opening position P1 at the exceeding of a given force such as to cause the frangible bridges 90 to break.

According to the invention, the device 1 comprises releasing/engaging means 10 between the lid 3*b* and the collar 2 such as to allow the opening/closing of the lid 3*b* depending on the rotation angle reached by the cap 3 with respect to the collar 2, after the first displacement of the cap 3 on the outer surface 2*a* of the collar 2. Basically, the aforementioned releasing/engaging means 10 allow to maintain the cap 3 integral with the collar 2 within a given angular interval, or at a precise angle between the cap 3 and the collar 2 (denoted above as closing angle and, then, subsequently also denoted by the reference B2), whereas they allow the release from such engagement within another angular interval, or at a precise angle between the cap 3 and the collar 2 (denoted above as opening angle and, then, subsequently denoted by the reference B1).

During the first opening of the lid 3*b*, once the appropriate opening angle which allows the rotation between the lid 3*b* and the collar 2, and thus the lower portion 3*a*, has been identified, the user must exert a given force adapted to cause the frangible bridges 90 to break and, thus, the opening of the lid 3*b*. Once the lid 3*b* has been reclosed, the cap 3 must be rotated such as to reach a rotation angle different from that in which the opening of the lid 3*b* is allowed. The opening of the lid 3*b* is prevented at such different rotation angle.

According to the embodiment described herein, said releasing/engaging means 10 comprise two locking teeth 11 combined with the lid 3*b* and a guide 12 for such locking teeth 11 made on the outer surface 2*a* of the collar 2. In a further embodiment, the number of locking teeth 11 can vary, for example can be of only one locking tooth 11 in number, without thereby departing from the protection scope of the present invention. In a further embodiment of the invention not shown herein, the locking tooth 11, or the locking teeth 11, is/are combined with the collar 2, whereas the guide 12 is combined with the cap 3.

In the embodiment described herein, the guide 12 is provided with two first regions 12*a* along which the two locking teeth 11 are constrained to slide, such as to hold the lid 3*b* engaged with the collar 2 in its closing position P2, and two second regions 12*b* in which the two locking teeth 11 are contemporaneously free from constraints, such as to release the lid 3*b* from the engagement with the collar 2 and to thus allow the free rotation of the lid 3*b* with respect to the lower portion 3*a* of the cap 3 and to allow it to reach its opening position P1.

In specific, the two first regions 12*a* each comprise a jutting-out profile that can be engaged with at least one locking tooth 11*a* to lock the rotation of the lid 3*b*. The two jutting-out profiles are obtained on the outer surface 2*a* of the collar 2. The two second regions 12*b* are thus arranged at the two areas of interruption between the two jutting-out profiles 12*a*.

The two locking teeth 11 protrude from the inner surface 14 of the lid 3*b*, whereas the two first regions 12*a* extend on the perimeter on part of the outer surface 2*a* of the collar 2.

According to the invention, the device 1 further comprises limiting means 50 for limiting the rotation between the cap 3 and the collar 2.

In particular, the limiting means 50 for limiting the rotation comprise a first protruding element 51 protruding from the lower portion 3*a* of the cap 3 and a seat 52 combined with the outer surface 2*a* of the collar 2. In further embodiments not shown herein, the limiting means 50 for limiting the rotation comprise a first protruding element 51 protruding from the outer surface 2*a* of the collar 2 and a seat 52 combined with the lower portion 3*a* of the cap 3, without thereby departing from the protection scope of the present invention.

Figure 5B:
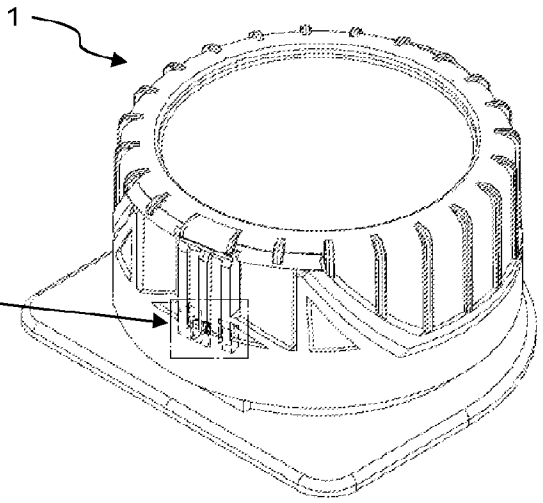
FIG. 5B is an axonometric top view of the device of FIG. 5A, rotated by 180°.
Figure 5C:
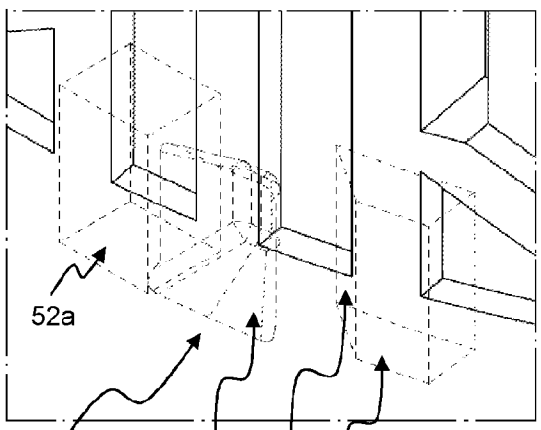
FIG. 5C is an axonometric view of the device of FIG. 5B, wherein the seat and the first protruding element of the limiting means for limiting the rotation are shown with dashed line.
Figure 5A:
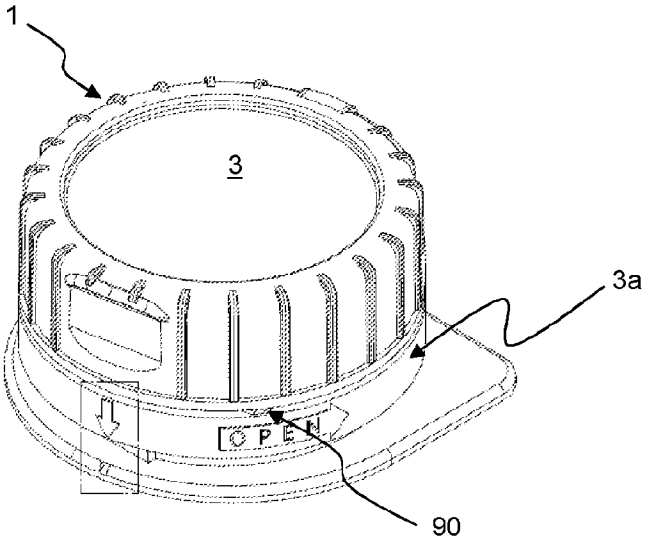
FIG. 5A is an axonometric top view of the device of FIG. 1A, when still closed.
Figure 6B:
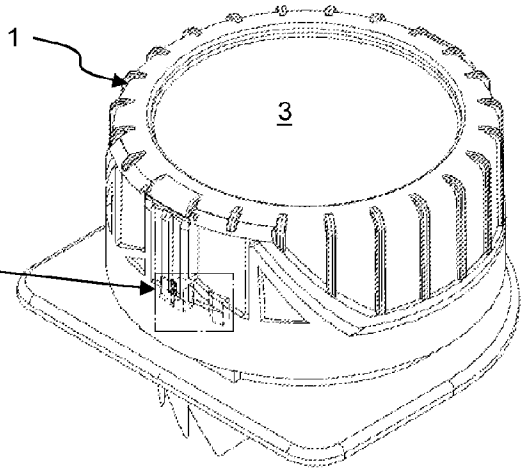
FIG. 6B is an axonometric top view of the device of FIG. 6A, rotated by 180°.
Figure 6C:
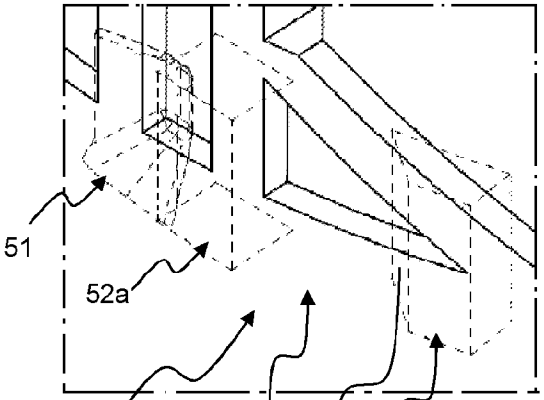
FIG. 6C is a particular view of the device of FIG. 6B, wherein the seat and the first protruding element of the limiting means for limiting the rotation are shown with dashed line in a mutual position such as the lid can be opened.
Figure 6A:
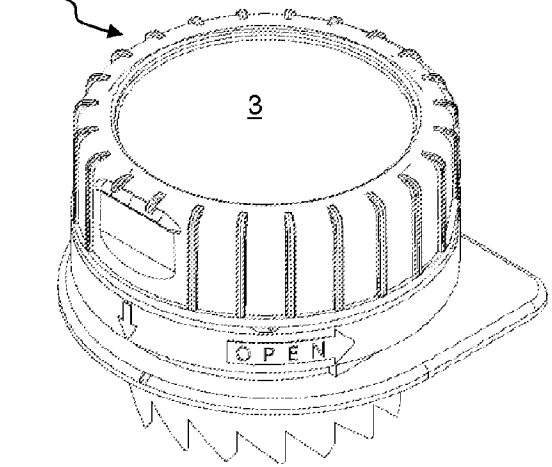
FIG. 6A is an axonometric top view of the device of FIG. 1B, when the pierceable portion has been ripped off.
Figure 7B:
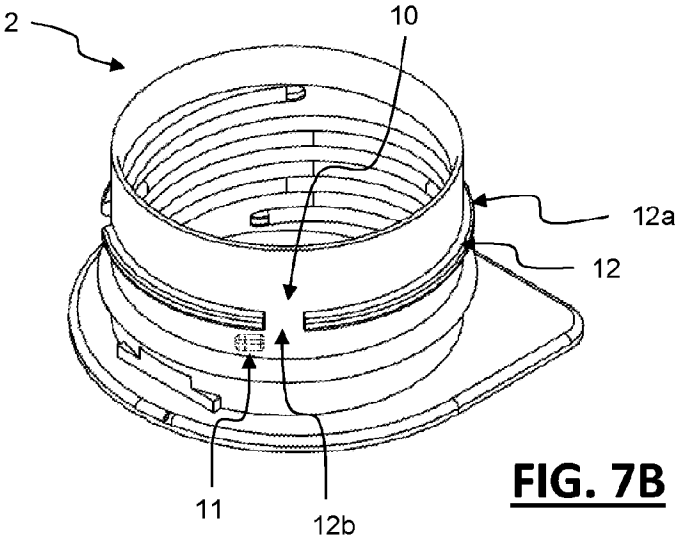
FIG. 7B is an axonometric top view of the collar of FIG. 7A, rotated by 180°, wherein the position of the tooth with respect to the guide is shown with dashed line.
Figure 7A:
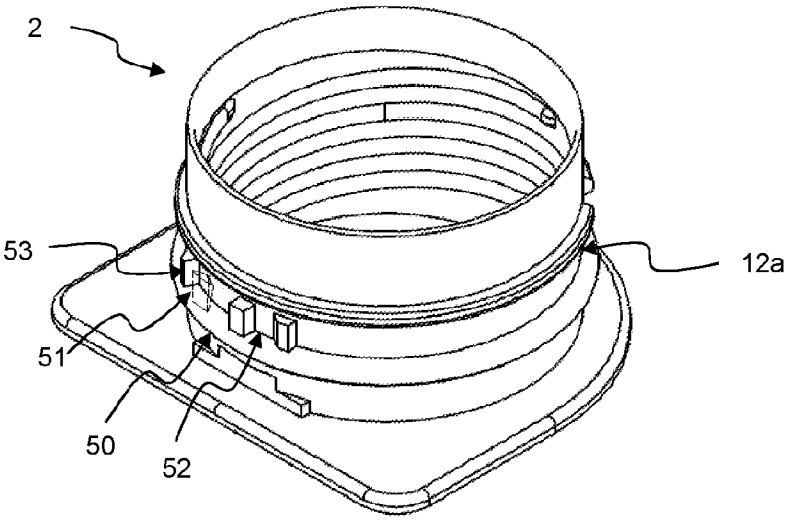
FIG. 7A is an axonometric top view of the collar, wherein the position of the first protruding portion, when arranged, following the rotation of the cap, within the given angular interval comprised between the second protruding element and the seat, is shown with dashed line.
Figure 8A:
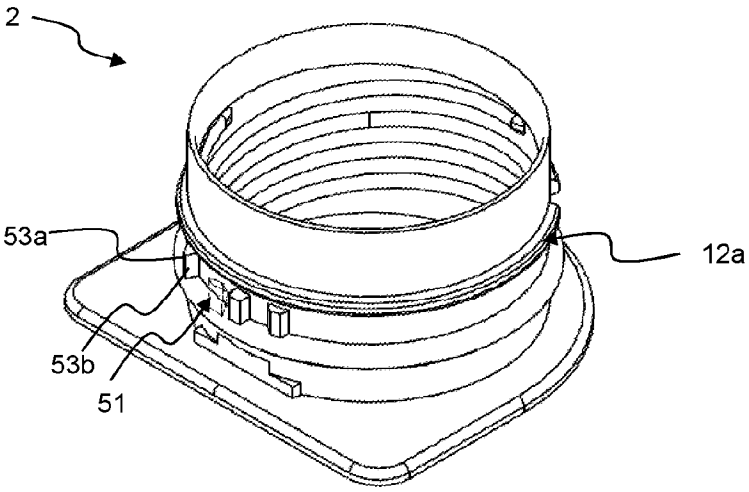
FIG. 8A is an axonometric top view of the collar, wherein the position of the first protruding portion, when arranged, following the rotation of the cap within the given angular interval comprised between the second protruding element and the seat, in a position such as to allow the opening of said lid, is shown with dashed line.
Figure 8B:
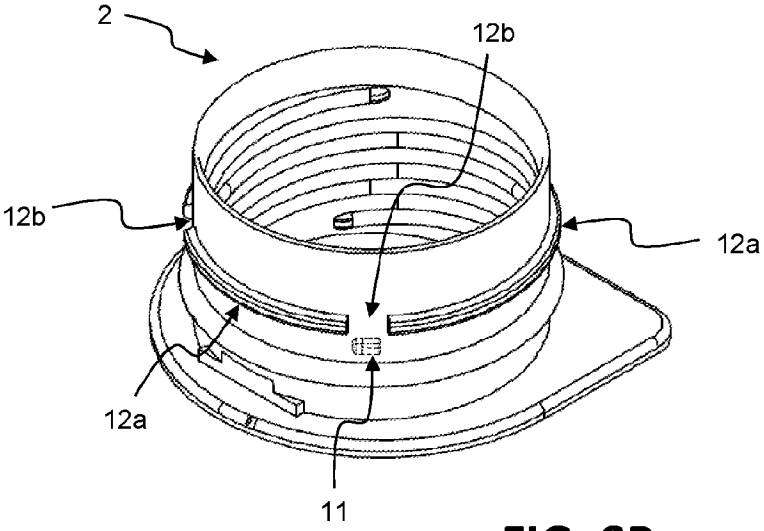
FIG. 8B is an axonometric top view of the collar of FIG. 8A, rotated by 180°, wherein the position of the tooth with respect to the guide is shown with dashed line.
Figure 9B:
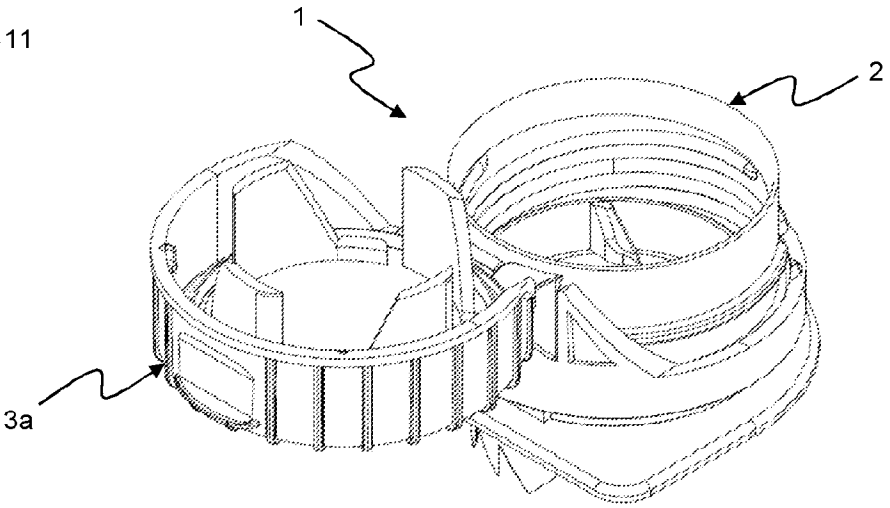
FIG. 9B is a further axonometric view of the opening/closing device of FIG. 9A, rotated by 180°.
Figure 9A:
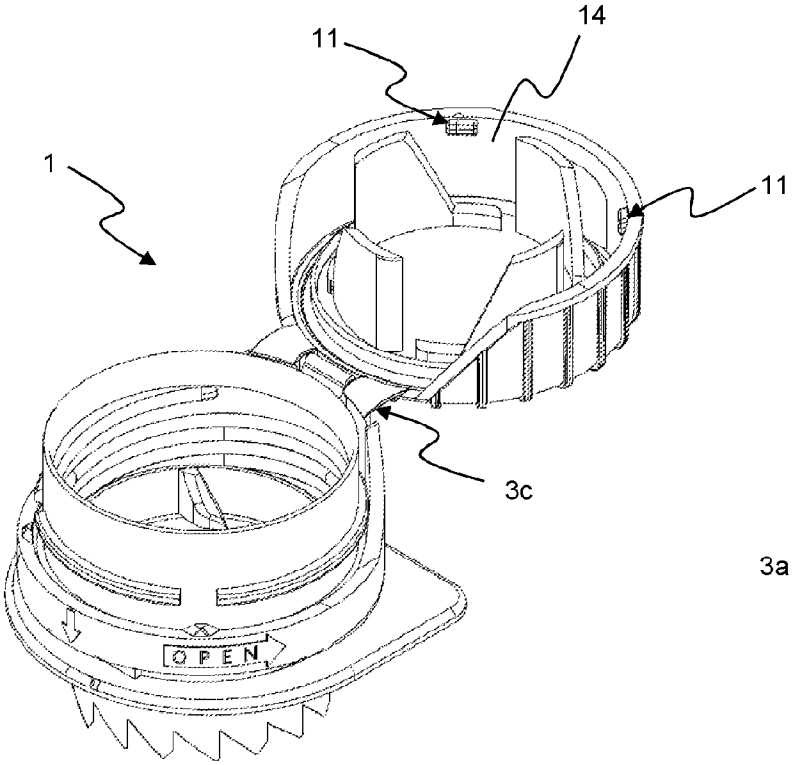
FIG. 9A is an axonometric view of the opening/closing device according to the invention, in which the cap is in its open position.

The first protruding element 51 is combined with the seat 52 at the end of the assembling operation T0 (see FIG. 5C) of the opening/closing device 1, such as to restrain the cap 3 in its assembled position with the collar 2, at least before the first displacement of the cap 3 on the outer surface 2*a* of the collar 2. In this assembled position the cap is arranged at an angle of 0° with respect to the collar 2.

According to the invention, the seat 52 is shaped to allow the rotation of the cap 3 in a first rotation direction L at the exceeding of a given torsional force to which the cap 3 is subjected. In the accompanying figures, the rotation direction is anticlockwise, without thereby limiting the protection scope of the present invention.

In particular, the seat 52 comprises two blocks 52*a* and 52*b*, wherein the second block 52*b* of the two blocks 52*a* and 52*b* has a ramp 52*c* which allows the first protruding element 51 to be able to go beyond the second block 52*b* at the exceeding of a given torsional force to which the cap 3 is subjected.

Always according to the invention, said limiting means 50 comprise a second protruding element 53 arranged on the outer surface 2*a* of the collar 2 and shaped to allow the rotation of the cap 3 in the first rotation direction L at the exceeding of a given torsional force to which the cap 3 is subjected and, subsequently, to prevent the rotation of the cap 3 in the opposite rotation direction R within the angular interval comprised between the seat 52 and the second protruding element 53. In practice, once the protruding element 51 has gone beyond the second protruding element 53, the cap 3 can rotate in both rotation directions L and R within the angular interval comprised between the second protruding element 53 and the seat 52, whereas it cannot return within the angular interval comprised between the seat 52 and the second protruding element 53. To this end, the second protruding element 53 has a second ramp 53*a* on the side that first comes into contact with the first protruding element 51, such as to make it easier for the first protruding element 51 to go beyond the second protruding element 52.

The two second regions 12*b* of the guide 12 are advantageously arranged on the outer surface 2*a* of the collar 2 in a position such as to be met by the two locking teeth 11 when the cap 2, rotated with respect to the collar 1, is in a position such as the first protruding element 51 is within the angular interval of rotation comprised between the second protruding element 53 and said seat 52. In practice, the opening of the lid 3*b* is only possible within the angular interval comprised between the second protruding element 53 and the seat 52, however—as will be described hereunder—not within the whole angular interval, but only at a very precise angle comprised within such angular interval.

Advantageously, the angular interval of rotation comprised between the second protruding element 53 and the seat 52 is between 330° and 355° starting from the assembled position of the cap 3 with respect to the collar 2.

According to further embodiments of the invention not shown herein, such rotation angle is between 100° and 355°, in particular between 300° and 355°.

Moreover, the two second regions 12*b* of the guide 12 are arranged on the outer surface 2*a* of the collar 2 in a position such as to be met by the two locking teeth 11 when the cap 3, rotated with respect to the collar 2, is in a position such as the first protruding element 51 is in abutment against the seat 52, within the angular interval of rotation comprised between the second protruding element 53 and the seat 52. In particular, when the first protruding element 51 is in abutment against the first block 52*a* of the seat 52. In such position, it will be possible to rotate the lid 3*b* with respect to the lower portion 3*a* of the cap 3 such as to allow to bring it in its opening position P1 and to thus allow the pouring of the product outside of the container 100. In the second embodiment described hereunder, such angular interval of rotation will be denoted by the reference B.

The opening of the lid 3*b* of the cap 3 is thus only possible at a well specified angle comprised within the angular interval comprised between the second protruding element 53 and the seat 52. Within this angular interval, the cap 3 can rotate in both directions, however, in a given angle the locking teeth 11 are at the second region 12*b* of the guide 12 and the opening of the lid 3*b* is thus allowed, the lid 3*b* no longer being integral with the collar 2. Once the product has been poured, the lid 3*b* is rotated in the opposite direction such as to reach its closing position P2 and the cap 3 is then rotated in the direction R opposite the first rotation direction L, always within the angular interval comprised between the second protruding element 53 and the seat 52, to reach a position such as the lid 3*b* is held locked with the collar 2. Such position is advantageously obtained when the first protruding element 51 comes into contact with the second protruding element 53, on its inner side 53*b*. Basically, within the angular interval comprised between the second protruding element 51 and the seat 52, the movement which allows the opening of the lid 3*b* is that of rotating the cap 3 with respect to the collar 2, until reaching the first block 52*a* of the seat 52, and of rotating the lid 3*b* with respect to the lower portion 3*a*, such as to switch from the closing position P2 to the opening position P1. It should be remembered that, at the first rotation of the lid 3*b* with respect to the lower portion 3*a*, the lid 3*b* and the lower portion 3*a* of the cap 3 are integrally constrained together by means of two frangible bridges 90. Thus, the user must use a given force to break the frangible bridges 90 connecting the aforementioned two elements.

Always within the angular interval comprised between the second protruding element 51 and the seat 52, the movement which allows the subsequent closing of the lid 3*b* is that of rotating the lid 3*b* with respect to the lower portion 3*a*, such as to switch from the opening position P1 to the closing position P2 and, subsequently, of rotating the cap 3 with respect to the collar 2, until the first protruding element 51 reaches the inner side 53*b* (i.e. the one not provided with the second ramp 53*a*) of the second protruding element 53. It should be specified that the elements such as the locking tooth 11, the first protruding element 51, the seat 52 and the second protruding element 53, are shown with dashed line in FIGS. 5B, 5C, 6B, 6C, 7A, 7B, 8A and 8B in their working position following the rotation of the cap 3 with respect to the collar 2, without however showing the cap 3 to simplify the drawing and to increase its understanding.

A further embodiment of the invention, which is different with respect to the one shown above for some characteristics which will be set forth hereunder, is shown in FIGS. 10A to 10L. It should be noted that identical numerical references will be used herein and hereunder to describe characteristics of the embodiment shown in FIGS. 10A to 10L that are identical to those of the first embodiment shown above.

The opening/closing device 1 used on a container 100 for pourable products having a pierceable portion 101 (not shown herein, but similar to those shown in FIGS. 1A, 1B and 1C) comprises a collar 2 combinable with the container at the pierceable portion 101, a cap 3 provided with a lower portion 3*a* and displaceable on the outer surface 2*a* of the collar 2 in a constrained and only rotatable way to first guiding means 40 interposed between the collar 2 and the lower portion 3*a*, and a cutting element 5 movable inside the collar 2 in a constrained way by second guiding means 60 interposed between the cutting element 5 and the collar 2 to sever the pierceable portion.

Like in the embodiment described above, such first guiding means 40 comprise a ring 41 running around the whole circumference of the collar and a corresponding U-shaped profile 42 integral with the cap 3, at its lower portion 3*a*, and adapted to slide on the ring 41 once the cap 3 has been assembled to the collar 2. In practice, the profile 42 is astride the ring 41 and shaped such as the cap 3 cannot be released from the collar 2 even if stressed by an upward vertical force. In a known way, the collar 2 also comprises a flange 2*b* constrained by gluing to the upper face 102 of the container 100, orthogonal to two faces 103 and 104, respectively to the side and front of the container 100 itself. Moreover, the cutting element 5 comprises appropriate teeth 5*a* to sever the aforementioned pierceable portion 101.

Still, the device 1 further comprises pushing means 7 for pushing the cutting element 5 and driven by the cap 3, during its first displacement, i.e. its first rotation, on the outer surface 2*a* of the collar 2, such as to aid the displacement of the cutting element 5 inside the collar 2 in direction of the pierceable portion. The cap 3 rotates around a central vertical axis V with respect to the collar 2. Moreover, the cap 3 comprises a lid 3*b* rotatably constrained with respect to the lower portion 3*a* of the cap 3 around a horizontal axis O, between an opening position P1 and a closing position P2, and vice-versa. The rotation between the lid 3*b* and the lower portion 3*a* of the cap 3 is obtained by means of a plastic hinge 3*c*. As shown in the accompanying figures, it should further be specified that the lid 3*b* and the lower portion 3*a* of the cap 3 are integrally constrained together by means of two frangible bridges 90 (only one is shown in the figures) before the first rotation of the lid 3*b* with respect to the lower portion 3*a*, such as to switch from the closing position P2 to the opening position P1 at the exceeding of a given force such as to cause the frangible bridges 90 to break.

According to the invention, the device 1 comprises releasing/engaging means 10 between the lid 3*b* and the collar 2 such as to allow the opening/closing of the lid 3*b* depending on the rotation angle reached by the cap 3 with respect to the collar 2, after the first displacement of the cap 3 on the outer surface 2*a* of the collar 2. Basically, the aforementioned releasing/engaging means 10 allow the release from such engagement in an opening angle B1 between the cap 3 and the collar 2 and prevent it in a different angle B2 with respect to the opening one, also named closing angle. During the first opening of the lid 3*b*, once the appropriate opening angle B1 which allows the rotation between the lid 3*b* and the collar 2 has been identified, the user must exert a given force adapted to cause the frangible bridges 90 to break and, thus, the opening of the lid 3*b*. Subsequently, once the lid 3*b* has been reclosed, the user will be able to rotate the cap 2 with respect to the collar 2, bringing it to a rotation angle B2 different from that in which the opening of the lid 3*b* is allowed with respect to the lower portion 3*a*, i.e. the opening angle B1.

In particular, the releasing/engaging means 10 allow the opening/closing of the lid 3*b* within an angular interval of rotation B reached by the cap 3 with respect to the collar 2, starting from the initial assembled position B0 of the cap 3 with respect to the collar 2. The releasing/engaging means 10 allow the opening of the lid 3*b*, in particular, within the aforementioned opening angle B1 of the angular interval B which is reached by the cap 3*b* in a first rotation direction L with respect to the collar 2, and, after the reclosing of the lid 3*b*, they prevent the opening of the lid 3*b* in a different angle B2 which is reached by the cap 3 in a rotation direction R opposite the first rotation direction L with respect to the collar 2. Such opening angle B1 is greater than, or equal to, the rotation angle N necessary for the cutting element 5 to sever the pierceable portion 101 and is measured, like for the rest of the other angles, starting from the initial assembled position of said cap 3 with respect to the collar. In particular, the assembled position of cap 3 is arranged at an angle of 0° with respect to the collar 2.

It should be noted that the number of opening angles B1 could also be greater than one, even be comprised within an opening interval B1, like the number of different closing angles B2 could be greater than one, i.e. be comprised within a closing interval B2, without thereby departing from the protection scope of the present invention. In this case, there is only one precise opening angle B, whereas many different opening angles B2 are joined within a closing interval B2 comprised within the aforementioned interval of operation B. In particular, as will be seen hereunder, the closing angle B2', which is at the end of the angular interval of rotation B opposite the angle B1, is comprised in such closing interval.

According to the embodiment described herein, the angular interval of rotation B is between 180° and 345°, however in further embodiments not shown herein, such angle of operation can be within an interval between 100° and 355°, and even more preferably between 300° and 355°, starting from the assembled position of the cap 3 with respect to the collar 2. In the embodiment described herein, the rotation angle N necessary for the cutting element 5 to sever the pierceable portion 101 is of 330°, starting from the initial assembled position B0 of the cap 3 with respect to the collar 2.

According to the embodiment described herein, said releasing/engaging means 10 comprise only one locking tooth 11 combined with the lid 3*b* and a guide 12 for such locking tooth 11 obtained on the outer surface 2*a* of the collar 2. In a further embodiment (such as the one described above in FIG. 1A to FIG. 9B), the number of locking teeth 11 can vary, for example be two in number, without thereby departing from the protection scope of the present invention. In a further embodiment of the invention not shown herein, the locking tooth 11, or the locking teeth 11, is/are combined with the collar 2, whereas the guide 12 is combined with the cap 3.

In the embodiment described herein, the guide 12 is provided with a first region 12*a* along which the locking tooth 11 is constrained to slide, such as to hold the lid 3*b* engaged with the collar 2 in its closing position P2, and a second region 12*b* wherein the locking tooth 11 is free from constraints, such as to release the lid 3*b* from the engagement with the collar 2 and to thus allow the free rotation of the lid 3*b* around the horizontal axis O with respect to the lower portion 3*a* of the cap 3 and to thus allow it to reach its opening position P1.

In specific, the first region 12*a* comprises an annular jutting-out profile that can be engaged with the locking tooth 11 such as to lock the rotation of the lid 3*b* around the horizontal axis O. The jutting-out profile 12*a* is obtained on the outer surface 2*a* of the collar 2. The second region 12*b* is thus arranged at the area of interruption of the jutting-out profile 12*a*. In this embodiment, the first region 12*a* extends angularly for about 345°, in any way, in another embodiment, such extension can also be smaller without thereby departing from the protection scope of the present invention.

The locking tooth 11 protrudes from the inner surface 14 of the lid 3*b*, whereas the first region 12*a* extends on the perimeter on part of the outer surface 2*a* of the collar 2.

Figure 10B:
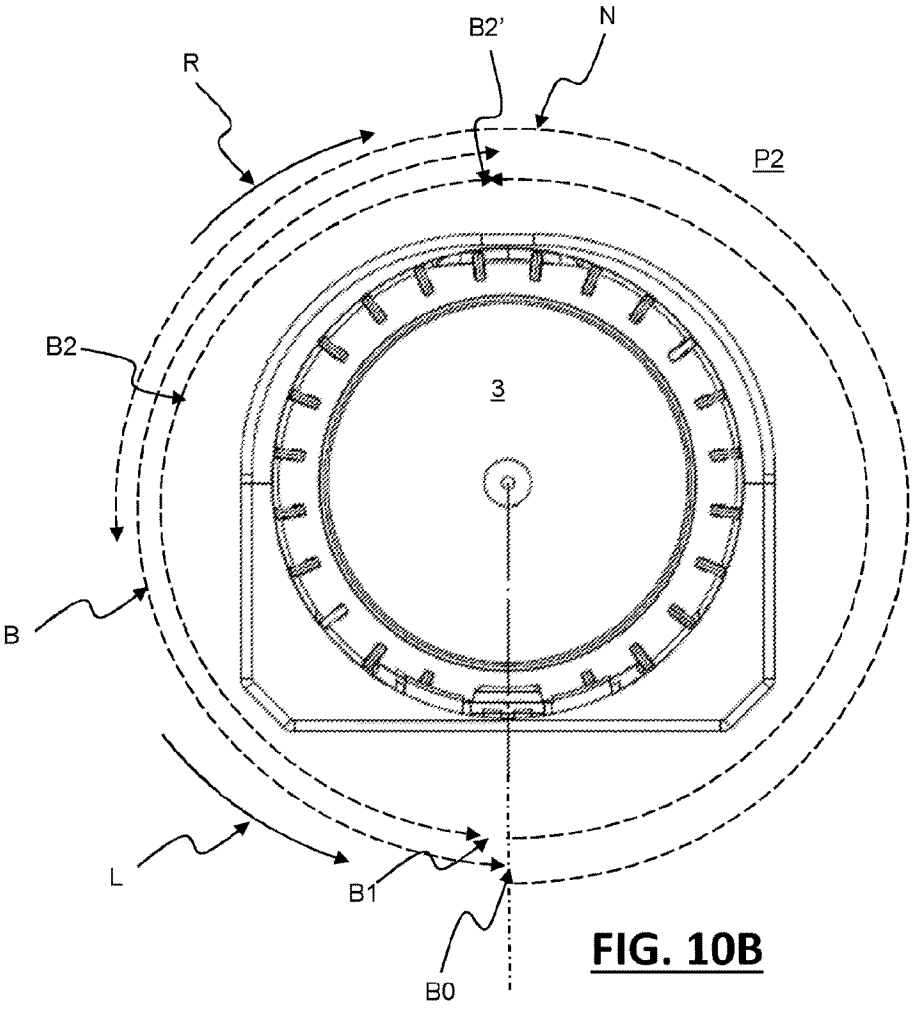
FIG. 10B is a top view of the device of FIG. 10A.
Figure 10A:
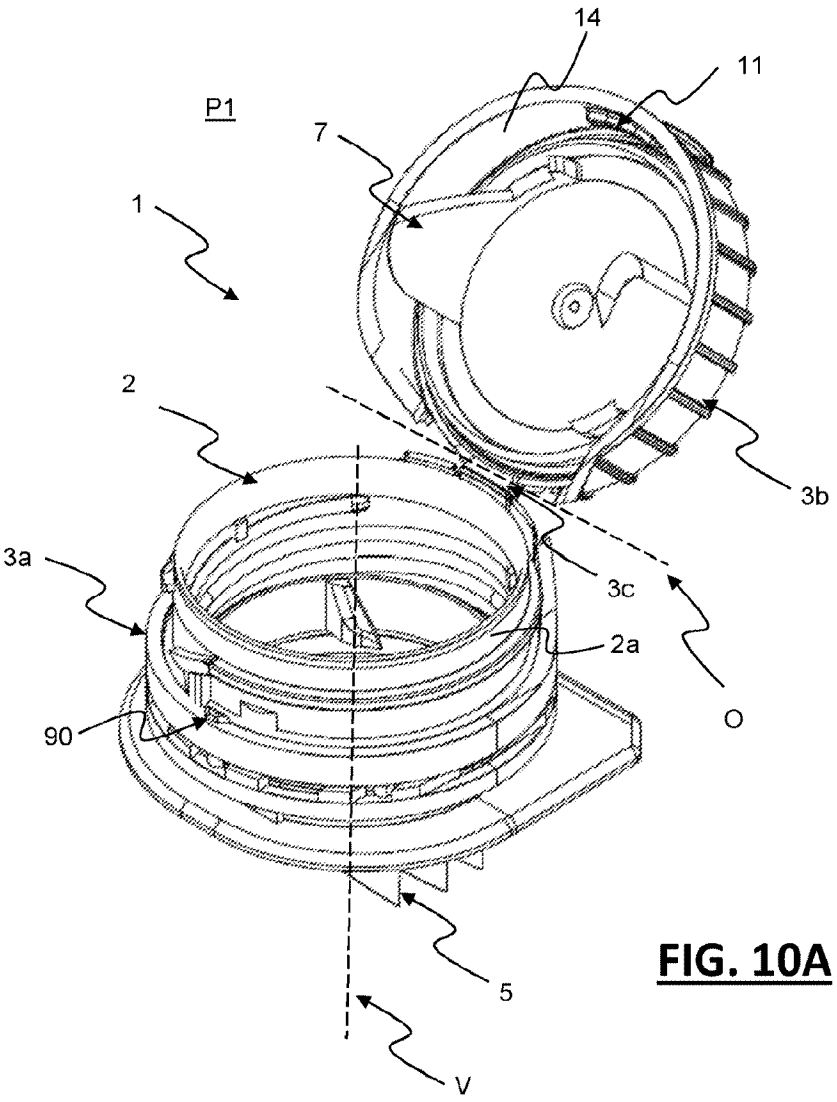
FIG. 10A is an axonometric view of an opening/closing device according to a further embodiment of the invention.
Figure 10D:
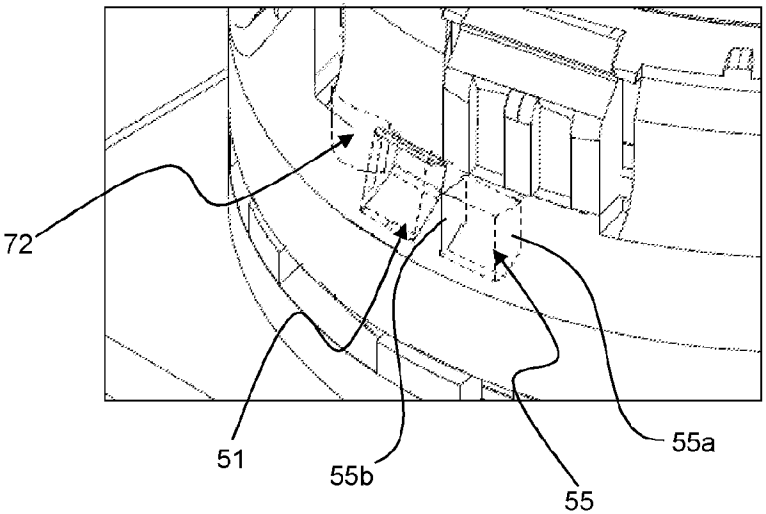
FIG. 10D is an axonometric view of a particular of FIG. 10C, wherein the reference element and the first protruding element of the limiting means for limiting the rotation, when the cap is in its opening position, are shown.
Figure 10C:
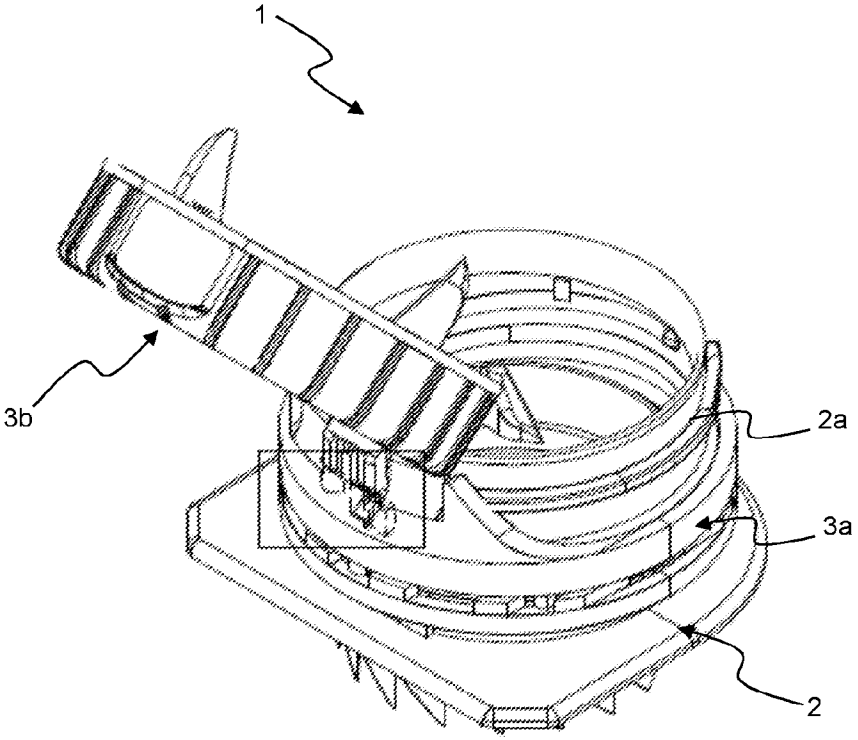
FIG. 10C is an axonometric view of the opening/closing device of FIG. 10A, rotated by 180°.
Figure 10F:
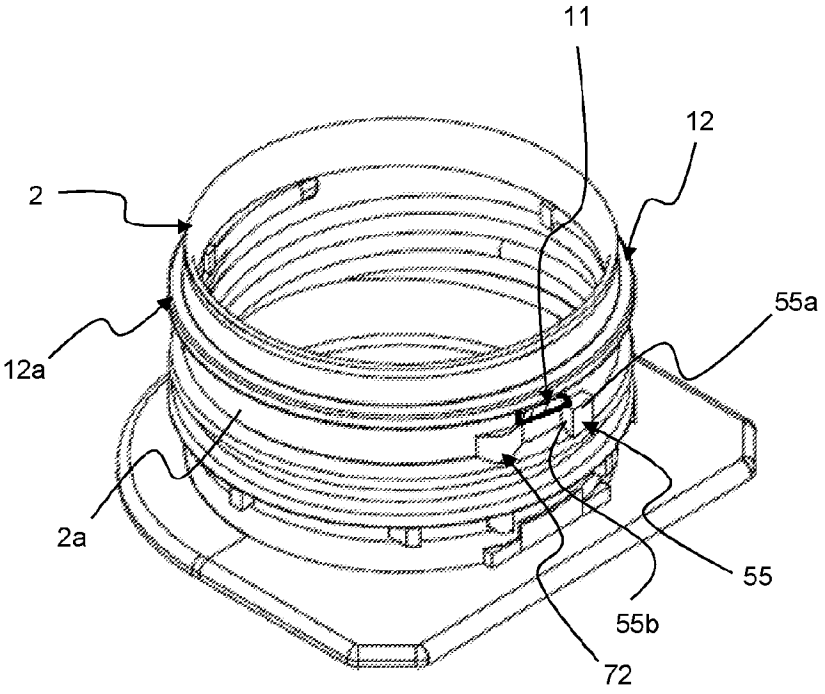
FIG. 10F is an axonometric view of the collar of the opening/closing device of FIG. 10A, wherein the locking tooth (combined with the cap which is not shown in figure for simplicity), as soon as the cap has reached the closing angle, is shown.
Figure 10E:
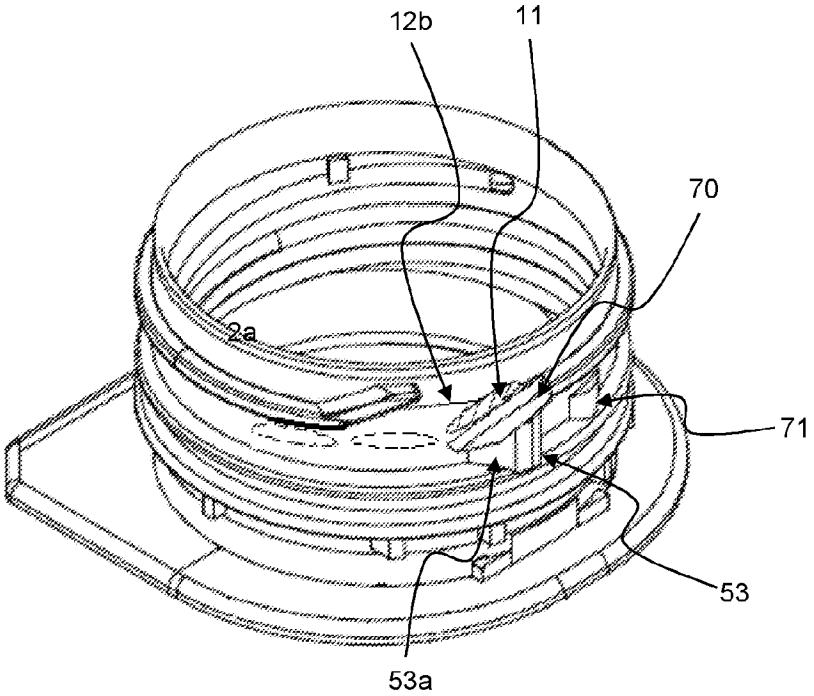
FIG. 10E is an axonometric view of the collar of the opening/closing device of FIG. 10A, wherein the locking tooth (combined with the cap which is not shown in figure for simplicity), during its displacement for reaching the opening angle, is shown.
Figure 10H:
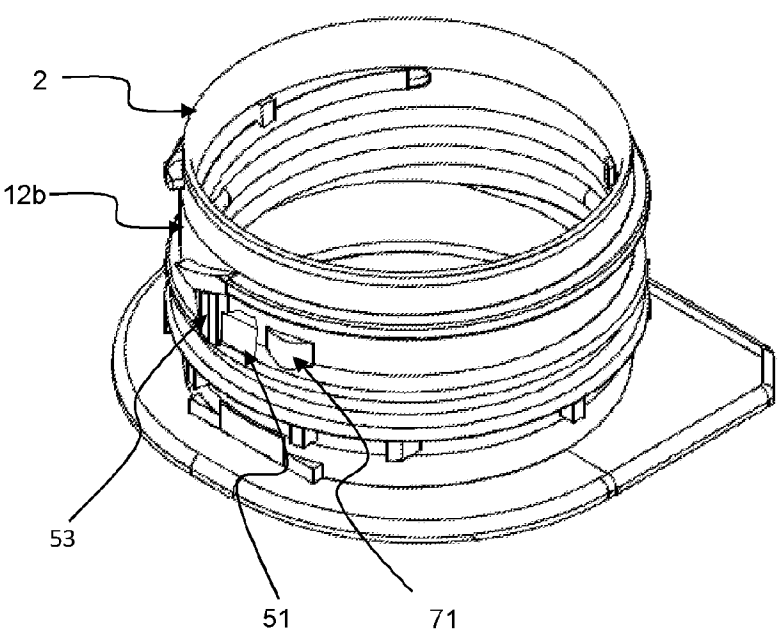
FIG. 10H is an axonometric view of the collar of the opening/closing device of FIG. 10F, wherein the first protruding element (combined with the cap which is not shown in figure for simplicity), arranged in position between the second protruding element and a stop element when the cap has reached the closing angle (shown in FIG. 10F), is shown.
Figure 10G:
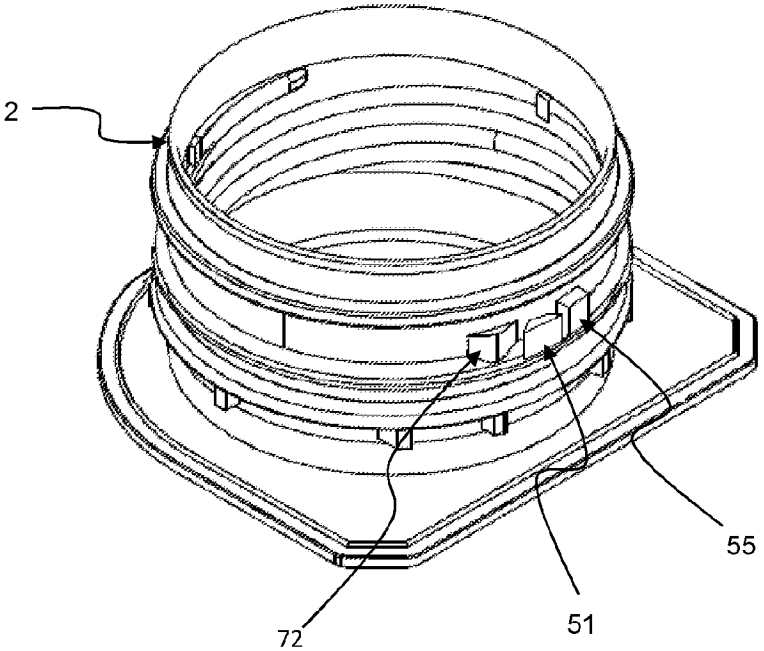
FIG. 10G is an axonometric view of the collar of the opening/closing device of FIG. 10E, wherein the first protruding element (combined with the cap which is not shown in figure for simplicity), arranged in position between the reference element and a stop element when the cap has reached the opening angle (shown in FIG. 10E), is shown.
Figure 10L:
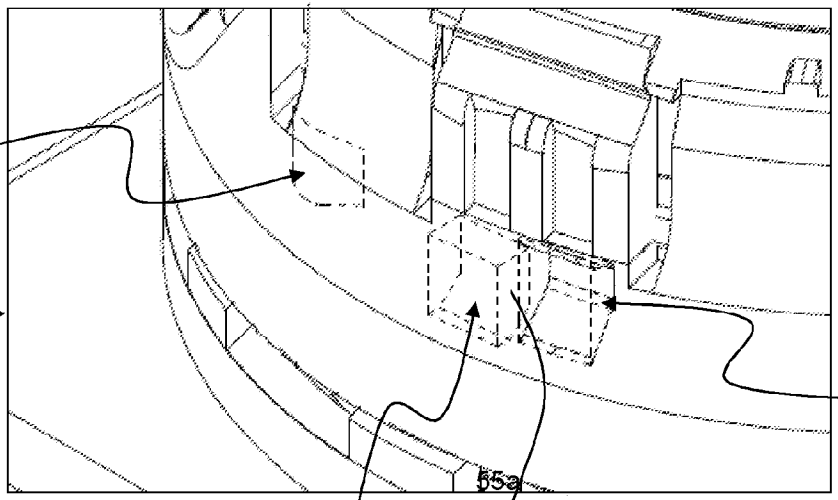
FIG. 10L is a particular axonometric view of the opening/closing device of FIG. 10I, wherein the reference element and the first protruding element are shown with dashed line.
Figure 10I:
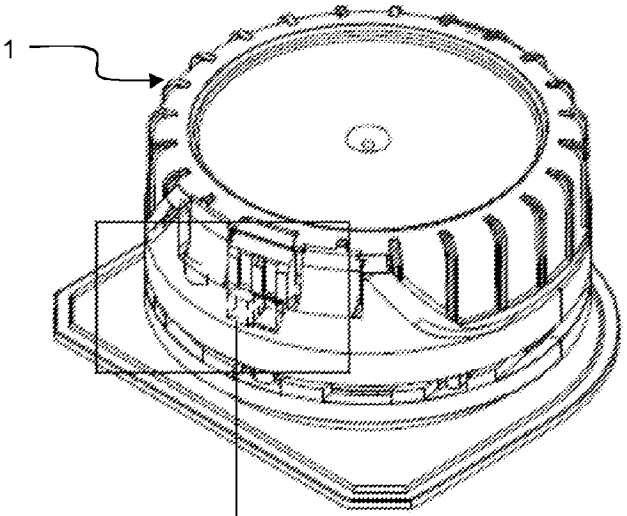
FIG. 10I is an axonometric view of the opening/closing device just assembled.
Figure 10N:
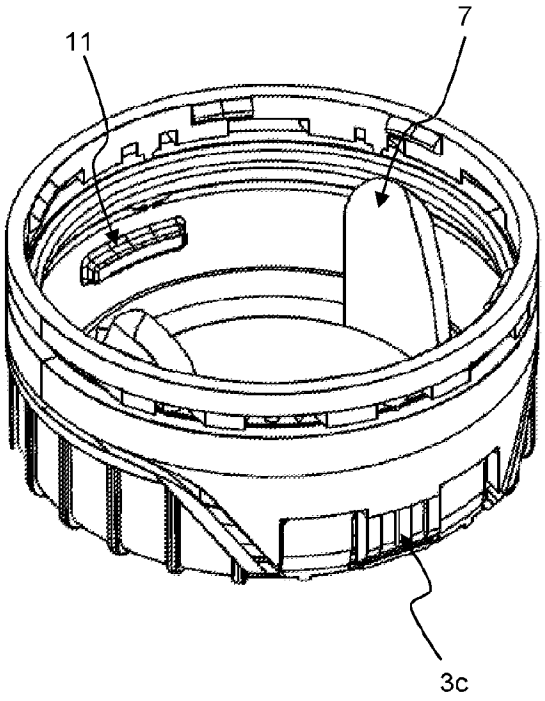
FIG. 10N is an axonometric bottom view of the cap of FIG. 10G rotated by 180°.
Figure 10M:
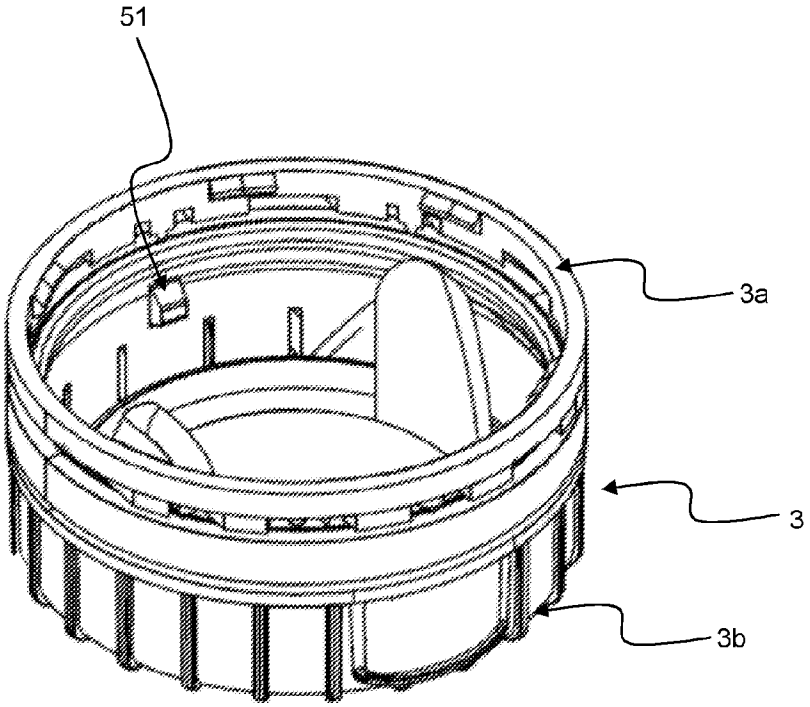
FIG. 10M is an axonometric bottom view of the cap of the opening/closing device of FIG. 10A.

According to the present embodiment, the limiting means 50 for limiting the rotation comprise a first protruding element 51 protruding from the lower portion 3*a* of the cap 3 and a reference element 55 to orient the cap 3 with respect to the collar 2 at the end of the assembling operation of the opening/closing device 1 (see FIG. 10L). The first protruding element 51 is combined in contact with a first surface 55*a* of the reference element 55 at the end of the assembling operation of the opening/closing device 1, at least before the first displacement of the cap 3 on the outer surface 2*a* of the collar 2. In the assembled position the cap 3 is arranged at the angle 0° with respect to the collar 2, or also denoted as angle B0 (see FIG. 10B).

In particular, the reference element 55 is shaped to allow the rotation of the cap 3 in the first rotation direction L away from the first surface 55*a* of the reference element 55.

The limiting means 50 further comprise a second protruding element 53 arranged on the outer surface 2*a* of the collar 2 and shaped to allow the rotation of the cap 3 in the first direction L at the exceeding of a given torsional force to which the cap 3 is subjected and, subsequently, to prevent the rotation of the cap 3 in the opposition rotation direction R, only after the first protruding element 51 has gone beyond the second protruding element 53. The second region 12*b* of the guide 12 are arranged on the outer surface 2*a* of the collar 2 in a position such as to be met by the locking tooth 11 when the cap 3, rotated with respect to the collar 2, is in a position such as the first protruding element 51 is within the interval of operation B (see FIGS. 10E, 10F, 10G and 10H).

According to the preferred embodiment of the invention, the interval of operation B is comprised between the second protruding element 53 and the second surface 55*b* of the reference element 55. Such angular interval of operation is of about 180°.

In practice, once the protruding element 51 has gone beyond the second protruding element 53, the cap 3 can rotate in both rotation directions L and R within the angular interval comprised between the second protruding element 53 and the second surface 55*b* (the one facing the angular interval of operation B) of the reference element 55, whereas it cannot return within the angular interval comprised between the first surface 55*a* of the reference element 55 and the second protruding element 53. To this end, the second protruding element 53 has a ramp 53*a* on the side that first comes into contact with the first protruding element 51, such as to make it easier for the first protruding element 51 to go beyond the second protruding element 53.

According to the invention, the second region 12*b* of the guide 12 is arranged on the outer surface 2*a* of the collar 2 in a position such as to be met by the locking tooth 11 when the cap 3, rotated with respect to the collar 2 in the first rotation direction L, is in a position such as the first protruding element 51 is in abutment against the second surface 55*a* of the reference element 55, within the angular interval of rotation comprised between the second protruding element 53 and the reference element 55, preferably at the opening angle B1 of the interval of operation B (see FIGS. 10E and 10G).

Still, the first region 12*a* of said guide 12 is arranged on the outer surface 2*a* of the collar 2 in a position such as to be met by the locking tooth 11 when the cap 3, rotated with respect to the collar 2 in the opposite rotation direction R, is in a position such as said protruding element 51 is within the angular closing interval B2 of the interval of operation B (see FIGS. 10F and 10H).

According to a particular aspect of the invention, the second region 12*b* of the guide 12 comprises a ramp 70 shaped to guide the locking tooth 11 along a path with vertical component, such as to push the lid 3*b* away with respect to the collar 2 and, thus, to the lower portion 3*a* of the cap 3, and to aid the opening of the lid 10. Such ramp 70 is reached by the locking tooth 11 when the first protruding element 51 reaches the opening angle B1 of the interval of operation B (see FIG. 10E).

According to a further particular aspect of the invention, the limiting means 50 further comprise two temporary stop elements 71 and 72 arranged in proximity of the second protruding element 53 and of second surface 55*b* of the reference element 55, such as the first protruding element 51 is restrained, respectively, within a preferred closing angle B2', within the angular closing interval B2 and within an opening angle B1 when arranged between the second protruding element 53 and the first stop element 71, and between the second stop element 72 and the second surface 55*b* of the stop element 55. The two stop elements 71 and 72 are shaped to allow the rotation of the cap 3 with respect to the collar 2 in direction of the different closing angle B2', starting from the opening angle B1, or of the opening angle B1, starting from the closing angle B2', at the exceeding of a further torsional force exerted by the user on the cap 3 when the first protruding element 51 is at the stop element 71 or 72.

Such temporary stops 71 and 72 are shaped like a double ramp such as to locally increase the effort of the user when the cap 3*b* is rotated and the first protrusion 51 meets such temporary stop elements 71 and 72.

Like in the embodiment described previously, the lid 3*b* and the lower portion 3*a* of the cap 3 are integrally constrained together by means of some frangible bridges 90 (only one is shown in the accompanying figures) at least before the first rotation of the lid 3*b* with respect to the lower portion 3*a*, such as to switch from the closing position P2 to the opening position P1 at the exceeding of a given force such as to cause the frangible bridges 90 to break. In this regard, the presence of the aforementioned ramp 70 not only aids the opening of the lid 3*b* each time it is necessary to pour the liquid contained in the container 100, but also allows to facilitate the breakage of such bridges 90 at the first opening of the container 100, i.e. the first time the lid 3*b* is raised and brought in the opening position P1. The number of frangible bridges 90 can also be one only without thereby departing from the protection scope of the present invention. The method of opening a container 100 for pourable products provided with an opening/closing device 1 according to one or more of claims 1 to 17, and in particular according to the embodiment described above, is described hereunder.

Such method comprises the steps of:

a) rotating the cap 3 with respect to the collar 2;

b) causing, during the step a), the displacement of the cutting element 5 in direction of the pierceable portion of the container 100 in order to sever it;

c) raising the lid 3*b* integral with the cap 3 from its closing position P2 to its opening position P1 to pour the product contained in the container 100;

wherein the step c) comprises the step c1) of allowing the opening/closing of the lid 3*b* depending on the rotation angle reached by the cap 3 during said step a) with respect to the collar 2, after the first displacement of the cap 3 on the outer surface 2*a* of the collar 2. The opening of the lid 3*b* is thus allowed only when the cap 3 reaches a rotation angle B1 such as the pouring is handier for the user and, once the lid 3*b* has been reclosed, it is possible to lock it in stable position with the collar 2 by rotating the cap 3 with respect to the collar 2 such as to reach a different rotation angle B2 with respect to that in which the lid 3*b* can be rotated with respect to the lower portion 3*a* of the cap 3.

In specific, said step c) comprises the step c0) of causing the frangible bridges 90 integrally connecting the lid 3*b* with the lower portion 3*a* of the cap 3 to break at the first rotation of the lid 3*b* with respect to the lower portion 3*a* during said step c), such as to switch from the closing position P2 to the opening position P1. Such operation ensures that the lid 3*b* always stays in the closed position before being able to be opened for the first time by the user.

In particular, the step of combining the cap 3 with the collar 2 is provided before the step a), such as a first protruding element 51 protruding from the lower portion 3*a* of the cap 3 is combined with a seat 52 combined with the outer surface 2*a* of the collar 2, or vice-versa. The step a) comprises the step a1) of allowing, by appropriately shaping the seat 52, the rotation of the cap 3 with respect to the collar 2 in a first rotation direction L at the exceeding of a given torsional force to which the cap 3 is subjected. In such assembled position the cap 3 is arranged at an angle of 0° with respect to the collar 2.

Moreover, the step a) comprises the step a2) of making the first protruding element 51 reach and go beyond the second protruding element 53 during the rotation of the cap 3 in the first rotation direction L. The second protruding element 53 is thus arranged on the outer surface 2*a* of the collar 2 and shaped to allow the rotation of the cap 3 in the first rotation direction L at the exceeding of a given torsional force to which the cap 3 is subjected and to subsequently prevent the rotation of the cap 3 in the opposite rotation direction R, only after the first protruding element 51 has gone beyond the second protruding element 53. In fact, the rotation in the opposite rotation direction R will be prevented by the engagement of the second protruding element 53 with the first protruding element 51.

The two regions 12*b* of the guide 12 are arranged on the outer surface 2*a* of the collar 2 in a position such as to be met by the locking tooth 11 when the cap 3, rotated with respect to the collar 2, is in a position such as the first protruding element 51 is within the angular interval of rotation comprised between the second protruding element 53 and said seat 52, more specifically, between the second protruding element 53, on its inner side 53*b*, and the first block 52*a* of the seat 52.

In practice, the opening of the lid 3*b* of the cap 3 is only possible in the aforementioned angular interval comprised between the second protruding element 53 and the aforementioned seat 52. Within this angular interval, the cap 3 can rotate in both directions, however, the locking teeth 11 are contemporaneously at the two second regions 12*b* of the guide 12 in a given angle only and, thus, the opening of the lid 3*b* is allowed, the lid no longer being integral with the collar 2. The opening of the lid 3*b* of the cap 3 is thus only possible in the aforementioned angular interval comprised between the second protruding element 53 and the seat 52. Within this angular interval, the cap 3 can rotate in both directions, however, the locking teeth 11 are at the second region 12*b* of the guide 12 in a given angle only and the opening of the lid 3*b* is thus allowed, the lid 3*b* no longer being integral with the collar 2.

Such particular angle corresponds to that in which the first protruding element 51 is in contact with the seat 53. In particular, when the first protruding element 51 is in contact with the first block 52*a* of the seat 52.

Once the product has been poured, the lid 3*b* is rotated with respect to the lower portion 3*a* in the opposite direction such as to reach its closing position P2 and, subsequently, the cap 3 is rotated in the direction R opposite the first rotation direction L, such as to reach a position such as the lid 3*b* is held locked in position with the collar 2. Such position is advantageously obtained when the first protruding element 51 comes into contact with the second protruding element 53.

As far as the embodiment described in FIGS. 10A to 10H is concerned, the method of opening the container 100 is substantially similar to that described above for the first embodiment of the invention, with some slight differences which are described hereunder.

The steps a), b), c) and c1) of the method coincide with those of the embodiment described above.

In this case, the step c1) occurs whenever the cap 3 has reached an angular interval of operation B, measured starting from the initial assembled position of the cap 3 with respect to the collar 2, during the step a). The releasing/engaging means 10 allow the opening of the lid 3*b* within an opening angle B1 of the angular interval of rotation B which is reached by the cap 3 in a first rotation direction L with respect to the collar 2 and prevent the opening of the lid 3*b* in a different closing angle B2 of the angular interval B, which is reached by the cap 3*b* in a rotation direction R opposite the first rotation direction L with respect to the collar 2. The first opening angle B1 is greater than the rotation angle N necessary for the cutting element 5 to sever the pierceable portion 101 during the step b) of the method and is also measured starting from the initial assembled position of the cap 3 with respect to the collar 2. In this assembled position the cap 3 is arranged at an angle of 0° with respect to the collar 2.

Like also mentioned above, in the embodiment described herein, the interval of operation during said step c) of the method is between 180° and 345°. In further embodiments, such interval of operation is between 180° and 355°, or between 100° and 355° or between 300° and 355°, starting from the assembled position of the cap 3 with respect to the collar 2, without thereby departing from the protection scope of the present invention.

Still, the step c) comprises the step c0) of causing the frangible bridges integrally connecting the lid 3*b* to the lower portion 3*a* of the cap 3 to break at the first rotation of the lid 3*b* with respect to the lower portion 3*a* during the step c1), such as to switch from the closing position P2 to the opening position P1.

Moreover, the step of combining the cap 3 with the collar 2 is provided before the step a) such as the first protruding element 51 arranged on the lower portion 3*a* of the cap 3 is combined with the first surface 55*a* of the reference element 55 combined with the outer surface 2*a* of the collar 2, or vice-versa, at the end of the assembling operation of the opening/closing device 1. Unlike the embodiment described above, the step a) also comprises the step a1') of allowing, by appropriately shaping the reference element 55, the rotation of the cap 3 in a first rotation direction L away from the first surface 55*a* of the reference element.

Like in the previous embodiment, the step a) also comprises the step a2) of making the first protruding element 51 reach and go beyond the second protruding element 53 during the rotation of the cap 3 in the first rotation direction L, wherein—as mentioned above—the second protruding element 53 is arranged on the outer surface 2*a* of the collar 2 and shaped to allow the rotation of the cap 3 in the first direction L, at the exceeding of a given torsional force to which the cap 3 is subjected and to subsequently prevent the rotation of the cap 3 in the opposite rotation direction R, only after the first protruding element 51 has gone beyond the second protruding element 53.

Advantageously, the second region 12*b* of the guide 12 is arranged on the outer surface 2*a* of the collar 2 in a position such as to be met by the locking tooth 11 when the cap 3, rotated with respect to the collar 2, is in a position such as the first protruding element 51 is within the angular interval of rotation B comprised between the second protruding element 53 and the second surface 55*b* of the reference element.

Moreover, unlike the previous embodiment, the step c) further comprises the step c2) of guiding the locking tooth 11 along a ramp 70 obtained on the second region 12*b* of the guide 12 such as to make it follow a path with vertical component, such as to push the lid 3*b* away with respect to the collar and to aid the opening of said lid; such ramp 70 is reached by the locking tooth 11 when the first protruding element 51 reaches the opening angle B1.

Finally, the step c) also comprises the step c3) of restraining at least temporarily the first protruding element 51 in the first opening angle B1 and in a preferred closing angle B2' of the closing interval B2 contained within the angular interval B. Thus, the rotation of the cap 3 with respect to the collar 2 in direction of the second preferred closing angle B2', starting from the opening angle B1, or of the first opening angle B1, starting from the different closing angle B2, is only allowed at the exceeding of a further torsional force exerted by the user on the cap 3 such as to allow the first protruding element 51 to exceed the resistance of the two temporary stop elements 71 and 72. Such further torsional force must be greater than the usual torsional force exerted by the user to normally rotate the cap 3 with respect to the collar 2.

Finally, a method of producing an opening/closing device 1 according to one or more of claims 1 to 17, and in particular according to the embodiment described above, is also provided and comprises the step a) of injection molding the cap 3, the step b) of injection molding the collar 2, and the step c) of injection molding said cutting element 5, wherein the step a) comprises the step a0) of molding the lid 3*b* and the lower portion 3*a* of the cap 3 in one piece, wherein the lid 3*b* and the lower portion 3*a* of the cap 3 are integrally constrained together by means of two frangible bridges 90 before the first rotation of the lid 3*b* with respect to the lower portion 3*a*, such as to switch from the closing position P2 to the opening position P1 at the exceeding of a given force such as to cause the frangible bridges 90 to break. In practice, the lid 3*b* of the cap 3 is not closed on the lower portion 3*a* after being both molded by injection, as occurs in the closing devices of the known art named "flip top," but are directly molded together in one piece and separated following the breakage of the connecting frangible bridges 90. This significantly reduces the production and assembly times of the device 1, since the closing operation of the lid 3*b* with respect to the lower portion 3*a* is no longer needed.

It should be underlined that said step b) and said step c) of the production method can advantageously also occur simultaneously whenever the collar 2 and the cutting element 5 are made in one piece.

The invention claimed is:

1. An opening/closing device for a container for pourable products having a pierceable portion, said opening/closing device comprising a collar combinable with said container at said pierceable portion, a cap provided with a lower portion and displaceable on the outer surface of said collar in a constrained and only rotatable way by first guiding means interposed between said collar and said lower portion, and a cutting element movable in a constrained way inside said collar by second guiding means interposed between said cutting element and said collar to sever said pierceable portion, said device further comprising pushing means for pushing said cutting element and driven by said cap, at least during its first displacement on said outer surface of said collar, such as to aid the displacement of said cutting element inside said collar in direction of said pierceable portion, said cap comprising a lid rotatably constrained with respect to said lower portion of said cap between an opening position (P1) and a closing position (P2), and vice-versa, said cap further comprising releasing/engaging means between said lid and said collar such as to allow the opening/closing of said lid depending on the rotation angle reached by said cap with respect to said collar, after the first displacement of said cap on said outer surface of said collar, said opening of the lid being allowed only when said cap reaches a rotation angle (B1) such as the pouring is handier for the user and, once the lid has been reclosed, said lid being lockable in stable position with the collar by rotating the cap with respect to the collar to reach a rotation angle (B2) different from that in which said lid is rotatable with respect to the lower portion of the cap.

2. The device according to claim 1, wherein said releasing/engaging means allow the opening/closing of said lid within an angular interval (B) reached by said cap with respect to said collar starting from the initial assembled position of said cap with respect to said collar, said releasing/engaging means allowing the opening of said lid within said opening angle (B1) of said angular interval (B) which is reached by said cap in a first rotation direction (L) with respect to said collar and, subsequently to the reclosing of said lid, preventing the opening of said lid in said different closing angle (B2) of said angular interval (B), which is reached by said cap in a rotation direction (R) opposite said first rotation direction (L) with respect to said collar, optionally said opening rotation angle (B1) being equal to or greater than the rotation angle (N) necessary for said cutting element to sever said pierceable portion and being measured starting from said initial assembled position of said cap with respect to said collar, said cap being arranged at an angle of 0° with respect to said collar in said initial assembled position.

3. The device according to claim 2, wherein said angular interval (B) is between 100° and 355°, or between 180° and 355°, or between 300° and 355°, starting from the assembled position of the cap with respect to said collar.

4. The device according to claim 1, wherein said releasing/engaging means comprise a locking tooth combined with said lid and a guide for said locking tooth combined with the outer surface of said collar, or vice-versa, said guide being provided with a first region along which said locking tooth is constrained to slide, such as to hold said lid engaged with said collar in its closing position (P2), and with a second region wherein said locking tooth is free from constraints, such as to release said lid from the engagement with said collar and to allow said lid to reach its opening position (P1).

5. The device according to claim 4, wherein said first region comprises a profile jutting out on the outer surface of said collar and that can be engaged with said locking tooth to lock the rotation of said lid.

6. The device according to claim 4, wherein said locking tooth protrudes from the inner surface of said lid and said first region extends on part of the perimeter of said outer surface of said collar.

7. The device according to claim 4, wherein said second region of said guide comprises a ramp shaped to guide said locking tooth along a path with vertical component, such as to push said lid away with respect to said collar and to aid the opening of said lid, said ramp being reached by said locking tooth when said first protruding element reaches said opening angle.

8. The device according to claim 1, further comprising limiting means for limiting the rotation between said cap and said collar.

9. The device according to claim 8, wherein said limiting means for limiting the rotation comprise a first protruding element protruding from said lower portion of said cap and a seat combined with said outer surface of said collar, or vice-versa, wherein said first protruding element is combined with said seat at the end of the assembling operation of said opening/closing device, such as to restrain said cap in its assembled position with said collar, at least before the first displacement of said cap on said outer surface of said collar, said cap in said assembled position being arranged at an angle of 0° with respect to said collar.

10. The device according to claim 9, wherein said seat is shaped to allow the rotation of said cap in said first rotation direction (L) at the exceeding of a given torsional force to which said cap is subjected.

11. The device according to claim 8, wherein said limiting means for limiting the rotation comprise a first protruding element protruding from said lower portion of said cap and a reference element for orienting said cap with respect to said collar at the end of the assembling operation of said opening/closing device, wherein said first protruding element is combined in contact with a first surface of said reference element at the end of the assembling operation of said opening/closing device, at least before the first displacement of said cap on said outer surface of said collar, said cap being arranged at an angle of 0° with respect to said collar in said assembled position.

12. The device according to claim 11, wherein said reference element is shaped to allow the rotation of said cap in said first rotation direction (L) away from said first surface of said reference element.

13. The device according to claim 8, wherein said limiting means comprise a second protruding element arranged on said outer surface of said collar and shaped to allow the rotation of said cap in said first direction (L) at the exceeding of a given torsional force to which said cap is subjected and, subsequently, to prevent the rotation of said cap in the opposite rotation direction (R), only after said first protruding element has gone beyond said second protruding element, said second region of said guide being arranged on said outer surface of said collar in a position such as to be met by said locking tooth when said cap, rotated with respect to said collar, is in a position such as said first protruding element is in the angular interval of rotation between said second protruding element and said seat, or between said second protruding element and the second surface of said reference element.

14. The device according to claim 8, wherein said second region of said guide is arranged on said outer surface of said collar in a position such as to be met by said locking tooth when said cap, rotated with respect to said collar, is in a position such as said first protruding element is in abutment against said seat, or said second surface of said reference element, within the angular interval of rotation (B) between said second protruding element and said seat, or said reference element, optionally at said opening angle (B1) of said angular interval (B).

15. The device according to claim 14, wherein said limiting means comprise one or more temporary stop elements arranged in proximity of said second protruding element and/or said second surface of said reference element, or said seat, such as said first protruding element, when arranged between said second protruding element and a stop element of said one or more stop element, and/or between said stop element of said one or more stop elements and said seat, or said second surface of said stop element, is held in said opening angle (B1), or in said different closing angle (B2, B2'), said one or more stop elements being shaped to allow the rotation of said cap with respect to said collar in direction of said closing angle (B2, B2'), starting from said opening angle (B1), or from said opening angle starting from said different closing angle (B2, B2'), at the exceeding of a further torsional force exerted by the user on the cap when said first protruding element is at said one or more temporary stop elements.

16. The device according to claim 8, wherein said first region of said guide is arranged on said outer surface of said collar in a position such as to be met by said locking tooth when said cap, rotated with respect to said collar in said opposite rotation direction, is in a position such as said first protruding element is in abutment against said second protruding element, at said different closing rotation angle (B2) of said operation interval (B).

17. The device according to claim 1, wherein said lid and said lower portion of said cap are integrally constrained together by means of a frangible bridge before the first rotation of said lid (3*b*) with respect to said lower portion, such as to switch from said closing position (P2) to said opening position (P1) at the exceeding of a given force such as to cause said frangible bridge to break.

18. A method of closing/opening a container for pourable products provided with an opening/closing device according to claim 1, comprising the steps of:

a. rotating said cap with respect to said collar;

b. causing, during said step a), the displacement of said cutting element in direction of said pierceable portion of said container to sever it;

c. raising said lid integral with said cap from its closing position (P2) to its opening position (P1) to pour the product contained in said container;

wherein said step c) comprises the step c1) of allowing the opening/closing of said lid depending on the rotation angle reached during said step a) by said cap with respect to said collar, after the first displacement of said cap on said outer surface of said collar, said opening of the lid being allowed only when said cap reaches a rotation angle such as the pouring is handier for the user, and once the lid has been reclosed, said lid being lockable in stable position with the collar by rotating the cap with respect to the collar so that to reach a rotation angle different from that in which said lid is rotatable with respect to the lower portion of the cap.

19. The method according to claim 18, wherein said step c1) occurs whenever said cap, during said step a), has reached a certain angular interval (B) measured starting from the initial assembled position of said cap with respect to said collar, said releasing/engaging means allowing the opening of said lid within an opening angle (B1) of said angular interval (B) which is reached by said cap in a first rotation direction (L) with respect to said collar and, subsequently to the reclosing of the lid, preventing the opening of said lid in a different closing angle (B2) of said angular interval (B), which is reached by said cap in a rotation direction (R) opposite said first rotation direction (L) with respect to said collar, said angular opening (B1) being greater than the rotation angle (N) necessary for said cutting element to sever said pierceable portion during said step b) of the method and being measured starting from said initial assembled position of said cap with respect to said collar, said cap being arranged at an angle of 0° with respect to said collar in said assembled position.

20. The method according to claim 19, wherein said angular interval, during said step c) of the method, is between 100° and 355°, or between 180° and 355°, or between 300° and 355°, starting from the assembled position of the cap with respect to said collar.

21. The method according to claim 18, wherein said step c) comprises the step c0) of causing said frangible bridge, integrally connecting said lid to said lower portion of said cap, to break at the first rotation of said lid with respect to said lower portion during said step c1), such as to switch from said closing position (P2) to said opening position (P1).

22. The method according to claim 21, wherein before said step a), the step of combining said cap with said collar, such as a first protruding element protruding from said lower portion of said cap is combined at least with one seat, or with a first surface of a reference element, combined with said outer surface of said collar, or vice-versa, is provided and in that said step a) comprises the step a1) of allowing, by appropriately shaping said seat, the rotation of said cap with respect to said collar in a first rotation direction (L), at the exceeding of a given torsional force to which said cap is subjected, said cap in said assembled position (T0) being arranged at an angle of 0° with respect to said collar, or in that it comprises the step a1') of allowing, by appropriately shaping said reference element, the rotation of said cap in said first rotation direction (L) away from said first surface of said reference element.

23. The method according to claim 18, wherein said step a) comprises the step a2) of making said protruding element reach and go beyond said second protruding element, during the rotation of said cap in said first rotation direction (L), wherein said second protruding element is arranged on said outer surface of said collar and shaped to allow the rotation of said cap in said first direction, at the exceeding of a given torsional force to which said cap is subjected, and to subsequently prevent the rotation of said cap in the opposite rotation direction (R), only after said first protruding element has gone beyond said second protruding element, said second region of said guide being arranged on said outer surface of said collar in a position such as to be met by said locking tooth when said cap, rotated with respect to said collar, is in a position such as said first protruding element is within the angular interval of rotation comprised between said second protruding element and said seat, or said second surface of said reference element.

24. The method according to claim 18, wherein said step c) further comprises the step c2) of guiding said locking tooth along a ramp obtained on said second region of said guide such as to make it follow a path with vertical component, such as to push said lid away with respect to said collar and to aid the opening of said lid, said ramp being reached by said locking tooth when said first protruding element reaches said opening angle (B1).

25. The method according to claim 18, wherein said step c) comprises the step c3) of holding said first protruding element in said opening angle (B1) and/or in said closing angle (B2, B2') of said angular interval of operation, the rotation of said cap with respect to said collar in direction of said different closing angle (B2, B2'), starting from said opening angle (B1), or of said opening angle (B1), starting from said closing angle (B2, B2'), being allowed at the exceeding of a further torsional force exerted by the user on the cap to allow said first protruding element to exceed the resistance of said one or more temporary stop elements.

* * * * *